US008739924B2

(12) United States Patent
Johnson

(10) Patent No.: US 8,739,924 B2
(45) Date of Patent: Jun. 3, 2014

(54) ACOUSTIC PANEL

(75) Inventor: Lahnie Johnson, Tampa, FL (US)

(73) Assignee: LJ Avalon LLC, Tampa, FL (US)

( * ) Notice: Subject to any disclaimer, the term of this patent is extended or adjusted under 35 U.S.C. 154(b) by 0 days.

(21) Appl. No.: 12/381,784

(22) Filed: Mar. 17, 2009

(65) Prior Publication Data

US 2009/0178882 A1 Jul. 16, 2009

Related U.S. Application Data

(60) Division of application No. 11/389,355, filed on Mar. 24, 2006, now Pat. No. 7,503,428, which is a continuation-in-part of application No. 10/458,983, filed on Jun. 11, 2003, now Pat. No. 7,063,184.

(60) Provisional application No. 60/388,438, filed on Jun. 12, 2002.

(51) Int. Cl.
*E04B 1/82* (2006.01)

(52) U.S. Cl.
USPC ..... 181/290; 181/292; 181/284; 181/294; 52/144; 52/145

(58) Field of Classification Search
USPC ..... 181/290, 292, 284, 294; 52/144, 145
See application file for complete search history.

(56) References Cited

U.S. PATENT DOCUMENTS 2,495,636 A 1/1950 Hoeltzel et al.
2,497,912 A 2/1950 Rees
2,553,363 A 5/1951 Droeger
2,694,025 A 11/1954 Slayter et al.
2,923,372 A 2/1960 Maccaferrl
2,924,856 A 2/1960 Price
3,058,551 A 10/1962 Martin
3,136,397 A 6/1964 Eckel
3,308,586 A * 3/1967 Olson ..... 52/99
3,324,615 A 6/1967 Zinn
3,611,653 A 10/1971 Zinn
3,695,395 A * 10/1972 Ollinger et al. ..... 181/290
3,841,047 A 10/1974 Zinn
3,949,827 A 4/1976 Witherspoon
3,950,912 A 4/1976 Lundberg et al.
3,967,693 A 7/1976 Okawa
RE28,976 E 9/1976 Zinn
RE29,412 E 9/1977 Zinn
4,113,053 A 9/1978 Matsumoto et al.
4,160,491 A 7/1979 Matsumoto et al.
4,207,964 A 6/1980 Taguchi (Continued)

OTHER PUBLICATIONS

Barriers Materials Summary Sheet.*

*Primary Examiner* — Forrest M Phillips
(74) *Attorney, Agent, or Firm* — Frijouf, Rust & Pyle P.A.

(57) ABSTRACT

An apparatus and method is disclosed for an improved acoustic panel comprising a sound absorbing member defined by a first and second face surface and a plurality of peripheral edges. A sound blocking member is defined by a first and second face surface and a plurality of peripheral edge. The first face surface of the sound blocking member is secured relative to the second face surface of the sound absorbing member for blocking the transmission of sound therethrough. In another embodiment, the first face surface of the sound blocking member is spaced relative to the second face surface of the sound absorbing member for decoupling the sound blocking member from the sound absorbing member.

4 Claims, 20 Drawing Sheets

(56) References Cited

U.S. PATENT DOCUMENTS

| | | | | | |
|---|---|---|---|---|---|
| 4,248,325 | A | | 2/1981 | Georgopoulos | |
| 4,306,631 | A | | 12/1981 | Reusser | |
| 4,402,384 | A | | 9/1983 | Smith et al. | |
| 4,488,619 | A | * | 12/1984 | O'Neill | 181/290 |
| 4,605,090 | A | | 8/1986 | Melfi | |
| 4,607,466 | A | | 8/1986 | Allred | |
| 4,719,730 | A | * | 1/1988 | Winkowski | 52/238.1 |
| 4,805,734 | A | | 2/1989 | Mast | |
| 4,834,213 | A | | 5/1989 | Yamamoto et al. | |
| 5,009,043 | A | * | 4/1991 | Kurrasch | 52/145 |
| 5,217,771 | A | | 6/1993 | Schmanski et al. | |
| 5,272,284 | A | | 12/1993 | Schmanski | |
| 5,554,830 | A | * | 9/1996 | Muller et al. | 181/290 |
| 5,787,651 | A | | 8/1998 | Horn et al. | |
| 6,158,176 | A | * | 12/2000 | Perdue | 52/144 |
| 6,179,086 | B1 | * | 1/2001 | Bansemir et al. | 181/292 |
| 6,260,660 | B1 | * | 7/2001 | Yoerkie et al. | 181/290 |
| 6,266,936 | B1 | | 7/2001 | Gelin | |
| 2002/0117352 | A1 | * | 8/2002 | Veen et al. | 181/292 |

* cited by examiner

ACOUSTIC PANEL

CROSS-REFERENCE TO RELATED APPLICATIONS

This application is a division of application Ser. No. 11/389,355 filed Mar. 24, 2006 now U.S. Pat. No. 7,503,428. Application Ser. No. 11/389,355 filed Mar. 24, 2006 is a continuation-in-part of U.S. patent application Ser. No. 10/458,983 filed Jun. 11, 2003 now U.S. Pat. No. 7,063,184. U.S. patent application Ser. No. 10/458,983 filed Jun. 11, 2003 claims benefit of U.S. Patent Provisional application Ser. No. 60/388,438 filed Jun. 12, 2002. All subject matters set forth in patent application 11/389,355 filed Mar. 24, 2006 and application Ser. No. 10/458,983 and provisional application Ser. No. 60/388,438 are hereby incorporated by reference into the present application as if fully set forth herein.

BACKGROUND OF THE INVENTION

1. Field of the Invention

This invention relates to sound control and more particularly to an improved acoustical panel suitable for indoor use such as a ceiling tile and the like.

2. Background of the Invention

The prior art has known various types of devices and methods for reducing the level of sound within an environment. The various types of devices and methods of the prior art for reducing the level of sound within an environment included a diverse and variety of apparatuses and methods adapted for many as specific applications and uses.

One particular type of device for reducing the level of sound within an environment comprises the use of sound reducing panels and/or sound absorbing devices. Various types of sound reducing panels and sound absorbing devices have been incorporated by the prior art to reduce the level of sound and/or to selectively reduce or inhibit reflection of sound from reflective surfaces within an environment.

In some instances, the apparatuses and methods for reducing the level of sound within an environment selectively reduced the level of sound within an environment. Many of the apparatuses and methods for reducing the level of sound within an environment were specifically designed for providing enhancements for improving the acoustics within the environment. Sound reducing panels and sound absorbing devices have been employed in very large rooms such as auditoriums as well as smaller rooms such as recording studios, home theaters and the like.

Other apparatuses and methods for reducing the level of sound within an environment of the prior art reduce the overall level of acoustic noise and/or sound and/or noise within the environment. In many cases, sound absorbing apparatuses and methods were used to reduce the sound of operating machinery as well as being used for reducing the transmission of sound and/or noise between the adjacent walls of a building.

The following U.S. patents are representative of the attempts of the prior art to provide apparatuses and devices for reducing sound within an environment.

U.S. Pat. No. 2,495,636 to O. R. Hoeltzel et al. discloses a unit comprising a layer of loosely matted mass of fibrous material. A substantially impervious preformed and film of thermoplastic synthetic resin material is integralized with the fibers in one face of the loosely matted material. A fabric covering on the other face of the loosely matted layer is enfolded and is secured about the edges of the mass and the film. The mass, film and fabric are in the form of the sound proof flexible panel adapted to cover and soundproof a section of a wall.

U.S. Pat. No. 2,497,912 to W. M. Rees discloses an acoustic construction for the walls and ceilings of an enclosure comprising a sound absorbing layer overlying the wall and formed by a plurality of rectangles or tiles of fibrous material arranged in a plane. The edge of each of the tiles are contiguous to and slightly spaced from the edges of adjoining tiles. A renewable facing for the sound absorbing layer includes a plurality of thin sheets of porous material individual to the tiles. Each of the sheets having tabs at its edges integral with the sheets and resiliently held in place between adjacent edges of the tiles to hold the sheets in place over the face of the tiles.

U.S. Pat. No. 2,553,363 to C. C. Droeger discloses a non-combustible wall or ceiling of a plurality of parallel, latterly spaced, non-combustible primary furrings anchored thereon. Sound absorbent pads are arranged between adjacent pairs of furrings. A plurality of spaced, non-combustible secondary furrings extend extended transversely across the primary furrings and are secured thereto. Each of the secondary furrings comprise a portion lying in a plane parallel with the wall or ceiling and bridging between primary furrings and are provided with a multiplicity of perforations adapted to threadably receive threaded shanks of screws. A multi-perforate finish sheaths overlies the aforesaid parts.

U.S. Pat. No. 2,694,025 to G. Slayter et al. discloses a structural board comprising a core of glass fibers bounded into a porous self-sufficient layer. A layer of substantially inorganic cementitious material is integrated with at least one of the faces of the core. The cementitious layer is formed of a composition consisting essentially of an amide-aldehyde resin selected from the group consisting of urea formaldehyde and melamine formaldehyde and gypsum cement.

U.S. Pat. No. 2,923,372 to M. Maccaferri discloses an all plastic acoustic tile formed of a molded plastic material comprising a plate-like body having a rearwardly extending edge flange thereabout integral therewith. The body is formed to provide the front side thereof as a flat, planar face and having a multiplicity of apertures therethrough from the front face to and opening through the rear side all the body. Sound wave dampening tubes are molded integrally with the body projecting rearwardly from the rear side thereof. Each of the dampening tubes has a passage therethrough opening at the rear end thereof. Each of the dampening tubes is located on the rear side of the body in position with a body aperture opening into and forming the inlet to the passage of the dampening tube. The body has the rear side thereof formed with an annular recess therein about each of the dampening tubes providing a reduced thickness base portion of the body with which the tube is integrally joined.

U.S. Pat. No. 3,136,397 to O. C. Eckel discloses an assembly with two angular adjoining walls and a ceiling. The assembly comprises a plurality of panels with a first of the panels extending along the ceiling from the first wall. A second of the panels extends along the first wall below the ceiling panel. A Z-shaped retainer embodying one angular portion is attached to the first wall. Another angular portion extends laterally away from the wall indirectly below the first ceiling panel and above the second panel. And a third angular portion extends downwardly away from the ceiling panel. The ceiling first panel rests on the other angular portion of the retainer.

U.S. Pat. No. 3,949,827 to Witherspoon discloses an acoustical panel assembly having improved structural, decorative and acoustical properties. The panel assembly includes a perimeter frame. A thin septum member is supported in the center of the frame. A fibrous glass layer is positioned adjacent each side of the septum member. A molded, semi-rigid, fibrous glass diffuser member is positioned adjacent each of the fibrous glass layers. The assembly includes means for joining adjacent panel assemblies and, in one embodiment, an outer decorative fabric layer is positioned adjacent each of the outer surfaces of the diffuser members.

U.S. Pat. No. 3,967,693 to Okawa discloses a means and method for diminishing energy of sound. A corrugated cover having holes therethrough is mounted on a wall by ribs and an edge plate. The wall and edge plate together with the ribs and corrugated cover form a plurality of chambers, each cooperating with a plurality of the holes for diminishing the energy of impinging sound waves.

U.S. Pat. No. 4,113,053 to Matsumoto et al. discloses a sound absorbing body which can effectively be utilized as an exterior sound absorbing wall or an interior wall of a house. The sound absorbing body comprises a number of sound absorbing cavities inclined at an angle alpha which is smaller than 80 degrees with respect to a transverse horizontal sectional plane of the body. The sound absorbing cavities being opened at the sound incident surface.

U.S. Pat. No. 4,160,491 to Matsumoto et al. discloses a perlite sound absorbing plate and a sound insulating wall constructed by arranging a number of the plates side by side and by assembling together into one integral body. The plate is composed of a mixture including 1,000 cubic centimeters by bulk volume of formed perlite particles each having a diameter of 0.1 to 7.0 millimeters 100 to 140 grams of cement, liquid rubber latex containing 5 to 20 grams of solid ingredients and a suitable amount of water and produced by press molding with a compression ratio of 1.10 to 1.30. The wall is constructed by assembling a number of the plates each provided with a side groove with the aid of supporting columns and reinforcing plates, each having a ridge adapted to be engaged with the side groove of the plate.

U.S. Pat. No. 4,207,964 to Taguchi discloses a sound absorbing and diffusing unit provided for assembling an acoustic screen which can be placed or hung in front of a wall inside an acoustic room for improving a sound-effect therein. These units are detachably joined together with each other so that they may be easily separated and assembled again to form an acoustic screen having another shape or construction to adjust or modulate a sound-effect. A sound absorbing porous panel having a desired picture or pattern can be easily hung against a wall. The decorative panel can be reversely hung on the wall to provide another interior ornamentation. Accordingly, an acoustically correct room and a desired ornamentation on a wall inside the acoustic room can be easily obtained and changed without providing a rigid reverberating surface of the room.

U.S. Pat. No. 4,248,325 to Georgopoulos discloses an improved sound absorptive tackable space dividing wall panel or similar article in which a wire mesh screen is disposed within the sound absorptive material a distance from the tackable surface less than the length of the tack pin, thereby providing additional support for the tackable load without appreciably reducing the sound absorptive characteristics of the panel.

U.S. Pat. No. 4,306,631 to Reusser discloses a noise barrier or other type wall or building assembly including a plurality of spans each extending between spaced apart posts and having top and bottom girts affixed to the posts and in turn supporting a plurality or series of vertically disposed panels. Unique mating interlock elements integrally formed along both lateral edges of the wall or building exterior panels allow the sequential interconnection of all panels in a series by means of a rotating displacement of the individual panels to yield multilateral interlocking of the panels. The panel faces are configured to provide shadow texture, while masking of the posts and top girts in a free-standing type wall is obtained by a split cover assembly and split cap trim, respectively.

U.S. Pat. No. 4,402,384 to Smith et al. discloses a sound barrier system particularly suited for out-of-doors, ground-mounted installations, such as for a highway noise barrier comprising a vertical wall composed of successive individual wall sections arranged with immediately adjacent wall sections disposed at an intersecting angle to each other. Immediately adjacent wall sections are rigidly joined together in abutment along a common vertical joint. An earth anchor is anchored into the ground at each vertical joint. Each joint is secured to the corresponding earth anchor so that downwardly directed hold-down forces are applied by the earth anchors to the wall at the bottom portions of the joints.

U.S. Pat. No. 4,605,090 to Melfi discloses a post and panel type noise barrier fence formed of a plurality of concrete vertical posts or columns which have grooves to hold flat concrete panels between successive ones of the columns. The panels can have a stepped lower edge to accommodate elevational changes in the terrain. Also, certain of the columns have oppositely disposed recesses angled from each other so as to accommodate directional changes at the columns in the direction of the barrier fence.

U.S. Pat. No. 4,607,466 to Alfred discloses an acoustic panel having a porous layer and a generally rigid layer affixed to each other. The generally rigid layer includes at least one passageway opening on one side of the rigid layer and extending through the rigid layer to the porous layer. The porous layer is a fibrous material. The rigid layer is a concrete-type material, such as vermiculite-cement plaster. This acoustic panel further comprises a generally rigid planar surface positioned adjacent to the porous layer. This generally rigid planar surface can comprise an insulating layer affixed to the other side of the porous layer and a structural layer fastened to the insulating layer. The insulating layer is a polyurethane foam board. The structural layer is a particle board.

U.S. Pat. No. 4,805,734 to Mast discloses an acoustic wall for streets and parks and for garden-like designs consisting of several substantially U-shaped frame members arranged at a distance from one another, which frame members are connected among one another and have mats applied on their front and side surfaces. In order to substantially reduce the manufacture on location, the duration of setting up and the greening time on location, the acoustic wall consists of individual elements of which each has several U-shaped frame members which are secured at the ends of their long legs on a base. The base forms a rigid frame with fastening means for a lift for the lifting and transporting of the acoustic wall. One or several narrow-mesh mats are secured on the base, which mats prevent a falling out of material filled into the acoustic wall during transport.

U.S. Pat. No. 4,834,213 to Yamamoto et al. discloses a noise silencer for highways adapted to be stuffed in a joint gap formed in a highway. It has a rectangular casing and padding enclosed in the casing. The casing is provided with a vent hole adapted to be closed by a plug. Before mounting the noise silencer, air is firstly sucked out from the silencer through the vent hole to flatten the padding and the vent hole is plugged. After the silencer has been mounted, the vent hole is open to inflate the padding so that the silencer will be pressed against the opposite walls of the joint gap.

U.S. Pat. No. 5,217,771 to Schmanski et al. discloses a device for preventing the transmission of sound, the device being fabricated of polymer composition and comprising a hollow core member formed of fiber-reinforced thermosetting resin, and at least an outer member formed of unreinforced thermoplastic resin which is friction fit to the core member. The core member and outer members are preferably formed by pultrusion and extrusion, respectively. Adjacently disposed devices are connected together to form a fence-like barrier through which few or no sound waves are allowed to pass. This system is advantageously used to prevent sound waves emanating from a large transportation structure such as a highway, railroad track, or airport.

U.S. Pat. No. 5,272,284 to Schmanski discloses a sound wall for placement along a roadside for reducing the transmission of sound from a traffic area wherein the sound wall comprises a plurality of stiff, resilient containment members respectfully configured with the channel configuration and having an enclosed channel volume and continuous open side. Each channel volume is filled with a composite composition of rubber chips and binder compressed within the channel and substantially filling the channel volume. These containment members are stacked in nesting relationship to form a wall structure, with the open side being oriented toward the traffic area.

In my prior invention set forth in set forth in U.S. patent application Ser. No. 10/458,983 filed Jun. 11, 2003 and U.S. provisional application Ser. No. 60/388,438 filed Jun. 12, 2002, I disclosed a simple reliable and efficient apparatus for reducing sound and/or noise in an outdoor or hostile environment.

It is an object of the present invention to continue to improve upon my invention by adapting my invention for different applications.

Another object of this invention is to provide an improved acoustic panel suitable for use in building structures, land vehicles as well as seacraft and aircraft.

Another object of this invention is to provide an improved acoustic panel which is suitable for use as a ceiling panel in a suspended ceiling frame.

Another object of this invention is to provide an improved acoustic panel which is capable of replacing conventional ceiling panel in a suspended ceiling frame.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention an relates to an improved acoustic panel, comprising a sound absorbing member defined by a first and second face surface and a peripheral edge. A sound blocking member is secured to the second face surface of the sound absorbing member for blocking the transmission of sound through the sound reducing panel. The sound blocking member comprising a sheet of polymeric material having a weight equal to or greater than one pound per square foot.

In a more specific example of the invention, the sound absorbing member comprises a sheet of porous fiberglass material. In one embodiment of the invention, the sound blocking member is affixed to the second face surface of the sound absorbing member by an adhesive layer. In another embodiment of the invention, the sound blocking member is spaced from the second face surface of the sound absorbing member. The sound blocking member may be spaced from the second face surface of the sound absorbing member by a matrix of spacers or may be spaced from the second face surface of the sound absorbing member by a spacing sound absorbing member.

The sound blocking member comprises a sheet of mineral filled polymeric material having a weight equal to or greater than one pound per square foot. Preferably, the sound blocking member comprises a sheet of polymeric material having a thickness of approximately one-eighth of an inch and having a sound transmission coefficient greater than 25.

In another embodiment the improved acoustic panel includes an inner support frame defined within the sound absorbing member for inhibiting deformation of the sound absorbing member. The inner support frame may comprise a curable polymeric material impregnated into an interior portion of the sound absorbing member.

In a more specific embodiment of the invention, the invention is incorporated into an improved sound reducing ceiling panel for use with a suspended ceiling support frame comprising a sound absorbing member defined by a first and second face surface and a plurality of peripheral edges. A sound blocking member is secured to the second face surface of the sound absorbing member for blocking the transmission of sound through the sound reducing panel. The sound blocking member comprises a sheet of polymeric material having a weight equal to or greater than one pound per square foot. A porous covering sheet overlays the sound absorbing member and the sound blocking member. The plurality of peripheral edges of the sound absorbing member engage with the suspended ceiling support frame for supporting improved sound reducing ceiling panel.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
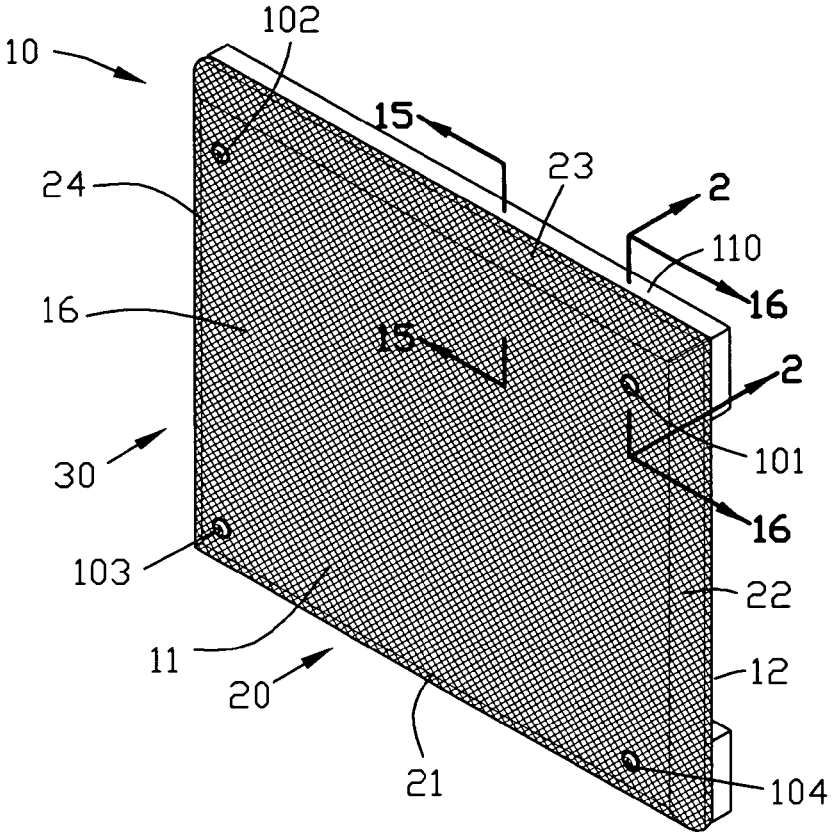
FIG. 1 is an isometric view of a first embodiment of an improved acoustic panel of the present invention installed on a support in an outdoor or a hazardous environment.

FIG. 1 is an isometric view of a first embodiment of an improved acoustic panel 10 of the present invention installed in an outdoor or a hazardous environment. The improved acoustic panel 10 comprises a first and a second face surface 11 and 12. Each of the first and second face surfaces 11 and 12 includes a multiplicity of pores 16 for receiving sound and/or noise from the environment.

The improved acoustic panel 10 comprises a plurality of peripheral edges 20 shown as peripheral edges 21-24. Although the improved acoustic panel 10 has been shown as having a rectangular configuration with four peripheral edges 21-24, it should be understood that the improved acoustic panel 10 may have configurations different than a rectangular configuration.

Figure 2:
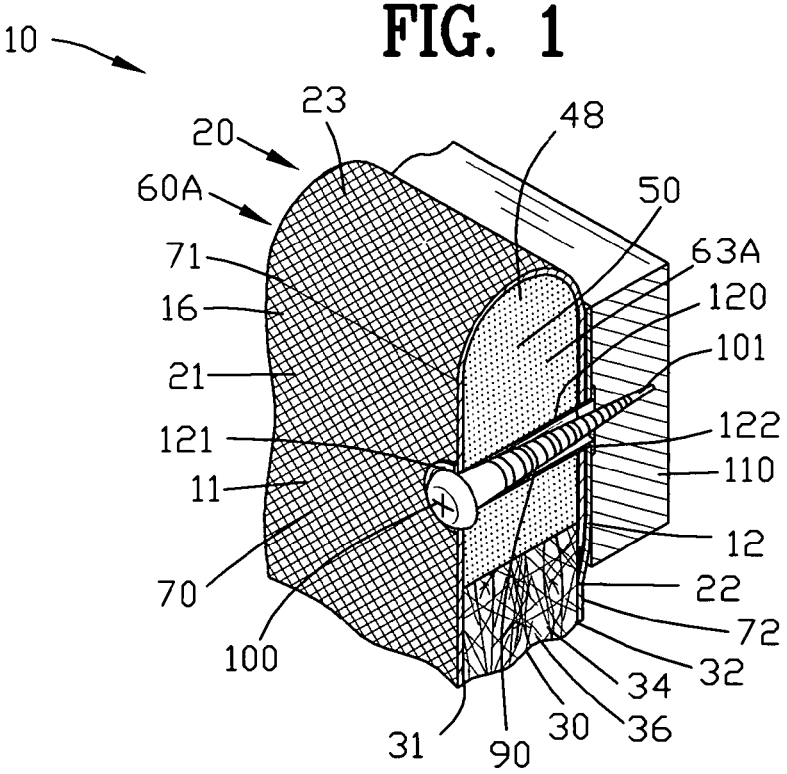
FIG. 2 is an enlarged isometric view along line 2-2 in FIG. 1.

FIG. 2 is an enlarged isometric sectional view along line 2-2 in FIG. 1. The improved acoustic panel 10 comprises a water resistant sound absorbing member 30 which comprises a first and a second face surface 31 and 32. The improved acoustic panel 10 is formed from a multiplicity of fibers 34 defining a multiplicity of pores 36 between adjacent fibers 34. The multiplicity of fibers 34 enables the sound and/or noise to enter through the multiplicity of pores 36 and to be dispersed by the multiplicity of fibers 34 within the water resistant sound absorbing member 30. In one example of the invention, the water resistant sound absorbing member 30 is formed from one to two inch thick fiber glass fiber board having a density of 6 pounds per square foot.

Figure 3:
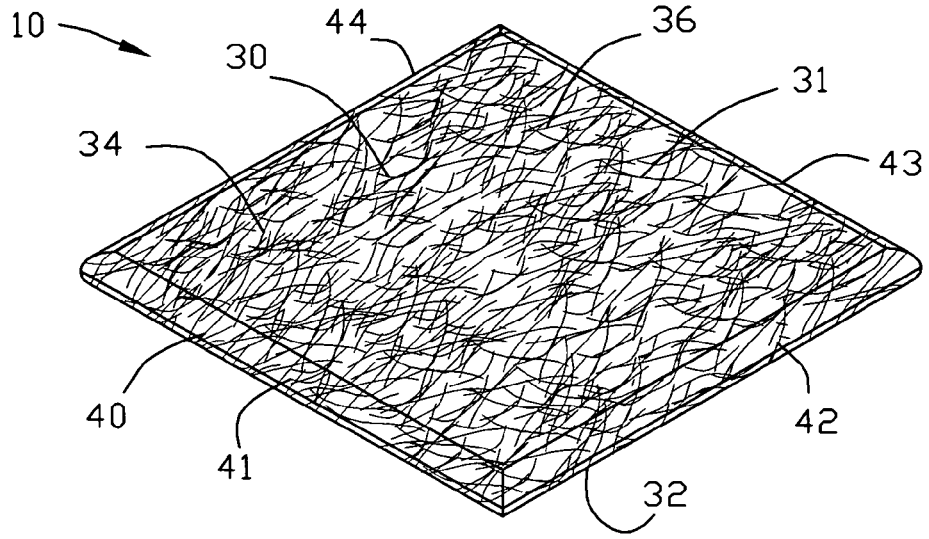
FIG. 3 is a top isometric view of water resistant sound absorbing member for forming the improved acoustic panel of the present invention that suitable for use in an outdoor or a hazardous environment.
Figure 4:
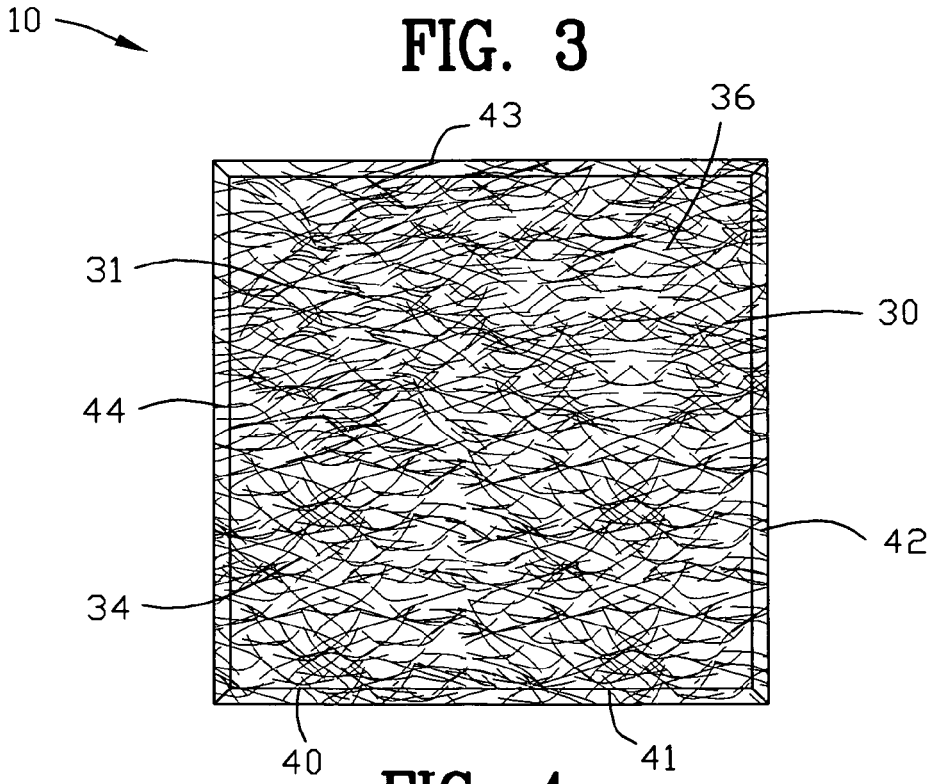
FIG. 4 is a top view of FIG. 3.
Figure 5:
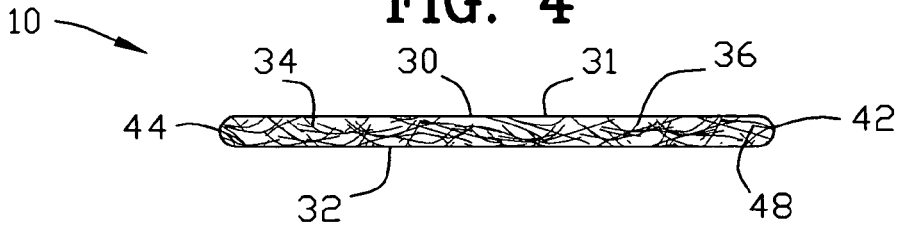
FIG. 5 is a side view of FIG. 4.

FIGS. 3-5 are various views of the water resistant sound absorbing member 30 of the present invention. The water resistant sound absorbing member 30 comprises the first and second face surfaces 31 and 32.

In this example the water resistant sound absorbing member 30 comprises a plurality of peripheral edges 40 shown as peripheral edges 41-44 in a rectangular configuration. In this first embodiment of the invention, each of the plurality of peripheral edge 41-44 has a substantially rounded cross-section 48. Although the water resistant sound absorbing member 30 has been shown in a rectangular configuration, it should be understood that the improved acoustic panel 10 may have numerous other configurations.

In one example of the invention, the water resistant sound absorbing member 30 is formed from a substantially rigid sheet of sound absorbing material. In the alternative, the water resistant sound absorbing member 30 may comprise a substantially flexible sheet of sound absorbing material.

FIGS. 6-11 illustrate various steps in the process of making the improved acoustic panel 10 of the present invention. A support frame 60 supports the flexible sheet of sound absorbing material. Preferably, the support frame 60 is located about the plurality of peripheral edges 40 of the water resistant sound absorbing member 30. The support frame 60 may comprises an internal frame or an external frame or a combination thereof. In the first embodiment of the invention, the support frame 60 comprises an internal frame 60A extending about the peripheral edges 41-44 of the water resistant sound absorbing member 30. The internal frame 60A comprises a curable polymeric material 50 to add rigidity to the improved acoustic panel 10.

The curable polymeric material 50 comprises a water resistant curable polymeric material 50 impregnated into a portion of each of the plurality of peripheral edges 41-44 of the sound absorbing member 30. In this example of the invention, the internal frame 60A comprises a first through fourth frame portion 61A-64A for providing rigidity to the water resistant sound absorbing member 30. In one example of the invention, the water resistant curable polymeric material 50 comprises a two part (resin and catalyst) curable polymeric material.

Figure 6:
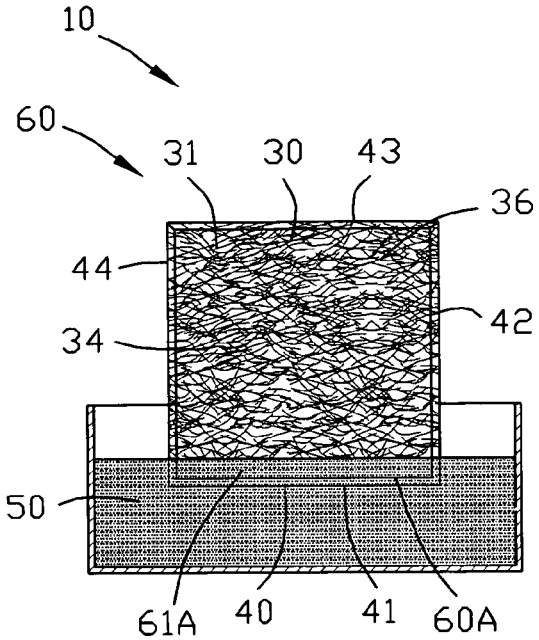
FIG. 6 illustrates a first step of making the first embodiment of the improved acoustic panel depicting the immersion of a first edge of a sound absorbing member into a water resistant curable polymeric material to form an internal frame.

FIG. 6 illustrates a first step of making the improved acoustic panel 10 of the present invention depicting the immersion of a first edge 41 of the sound absorbing member 30 into a water resistant curable polymeric material 50 to form the first frame portion 61A of the internal frame 60A.

Figure 7:
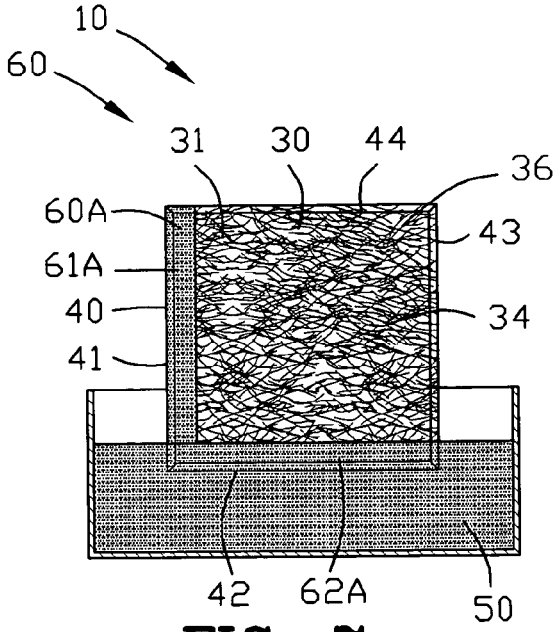
FIG. 7 illustrates a second step of making the first embodiment of the improved acoustic panel of FIGS. 1 and 2 depicting the immersion of a second edge of a sound absorbing member into the water resistant curable polymeric material.

FIG. 7 illustrates a second step of making the improved acoustic panel 10 depicting the immersion of the second edge 42 of a sound absorbing member 30 into the water resistant curable polymeric material 50 to form the second frame portion 62A of the internal frame 60A.

Figure 8:
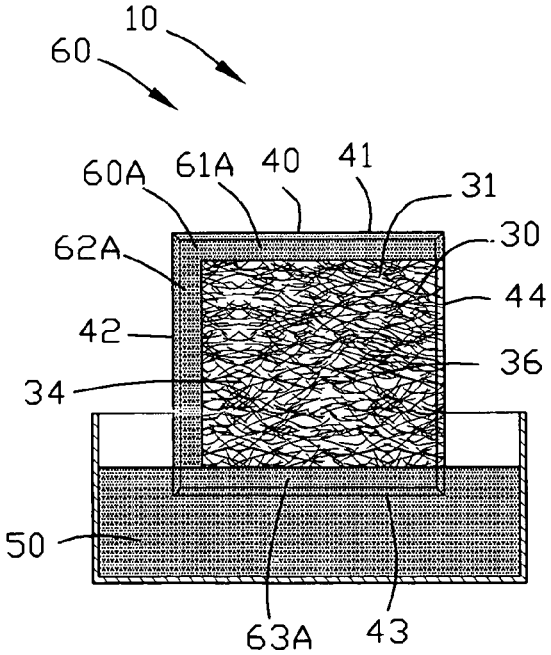
FIG. 8 illustrates a third step of making the first embodiment of the improved acoustic panel of FIGS. 1 and 2 depicting the immersion of a third edge of a sound absorbing member into the water resistant curable polymeric material.

FIG. 8 illustrates a third step of making the improved acoustic panel 10 depicting the immersion of the third edge 43 of a sound absorbing member 30 into the water resistant curable polymeric material 50 to form the third frame portion 63A of the internal frame 60A.

Figure 9:
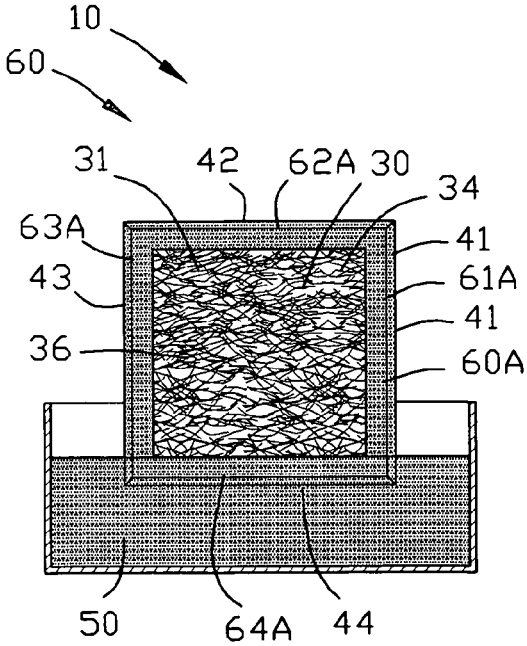
FIG. 9 illustrates a fourth step of making the first embodiment of the improved acoustic panel of FIGS. 1 and 2 depicting the immersion of a fourth edge of a sound absorbing member into the water resistant curable polymeric material to complete the internal frame.

FIG. 9 illustrates a fourth step of making the improved acoustic panel 10 depicting the immersion of the fourth edge 44 of a sound absorbing member 30 into the water resistant curable polymeric material 50 to form the fourth frame portion 64A of the internal frame 60A.

Figure 10:
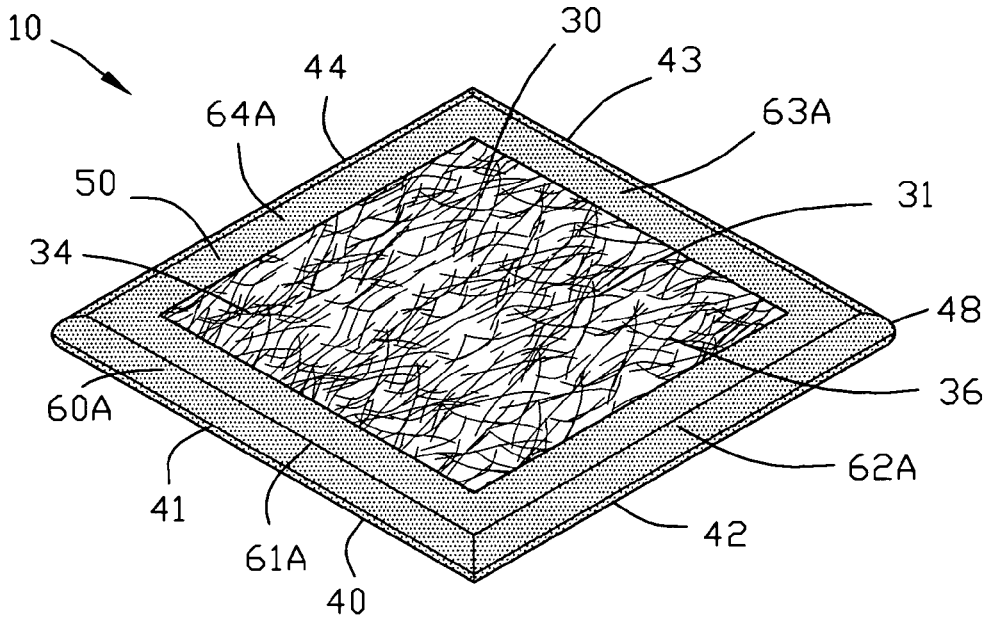
FIG. 10 is a top isometric view of the water resistant sound absorbing member with the internal frame formed from the impregnated water resistant curable polymeric material.
Figure 11:
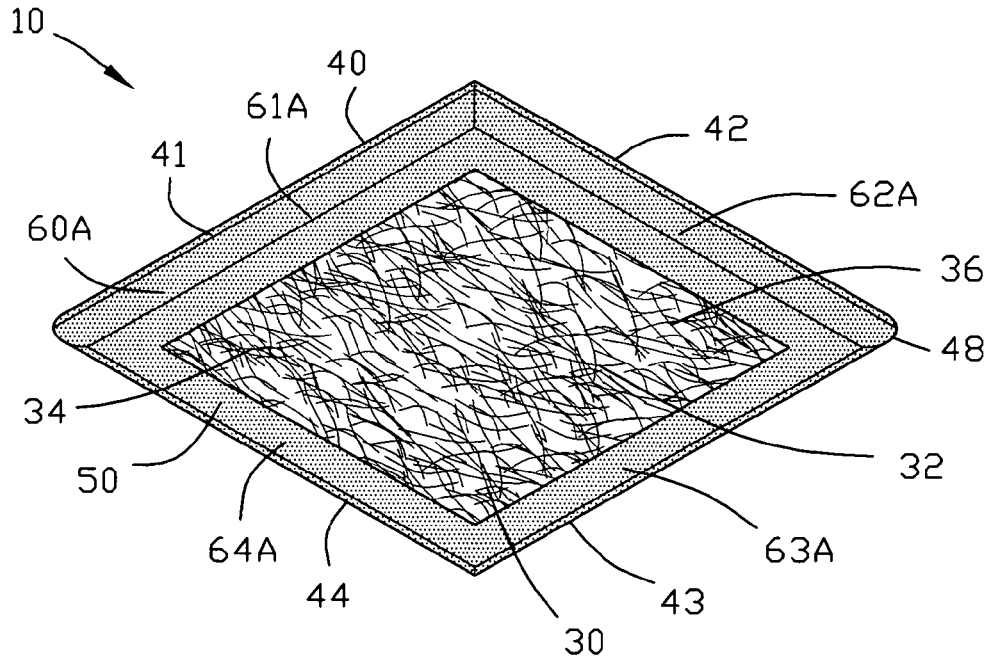
FIG. 11 is a bottom isometric view of FIG. 10.

FIGS. 10 and 11 are top and bottom isometric views of the water resistant sound absorbing member 30 with the completed internal frame 60A formed from the impregnated water resistant curable polymeric material 50. In this example of the invention, the water resistant sound absorbing member 30 comprises a substantially rigid sheet of sound absorbing material. In the alternative, the water resistant sound absorbing member 30 may comprise a substantially flexible sheet of sound absorbing material with the completed internal frame 60A supplying the necessary rigidity to the water resistant sound absorbing member 30.

Figure 12:
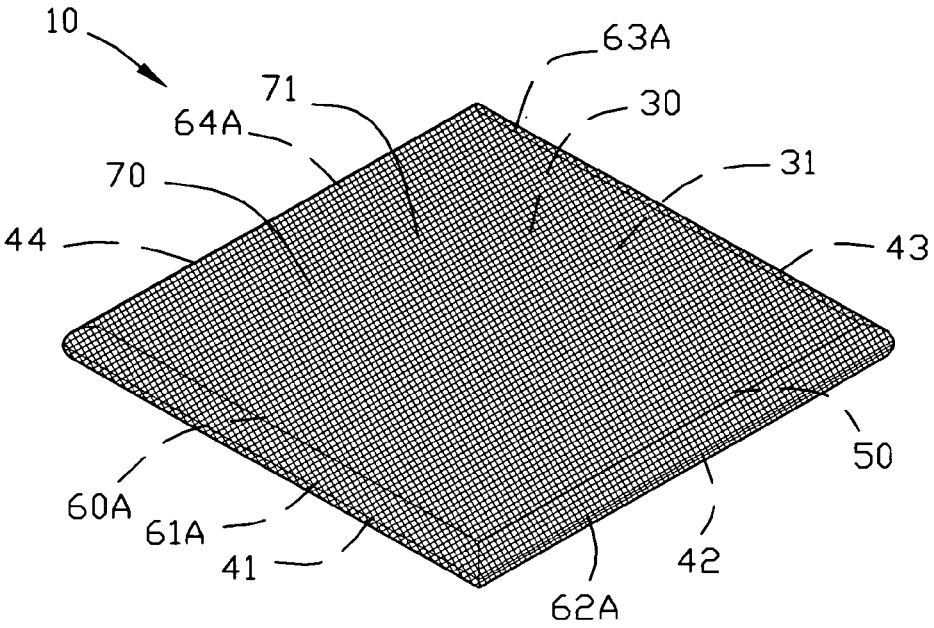
FIG. 12 is view similar to FIG. 10 illustrating a fifth step of making the first embodiment of the improved acoustic panel depicting a first face of the sound absorbing member being overlaid with a first covering sheet.
Figure 13:
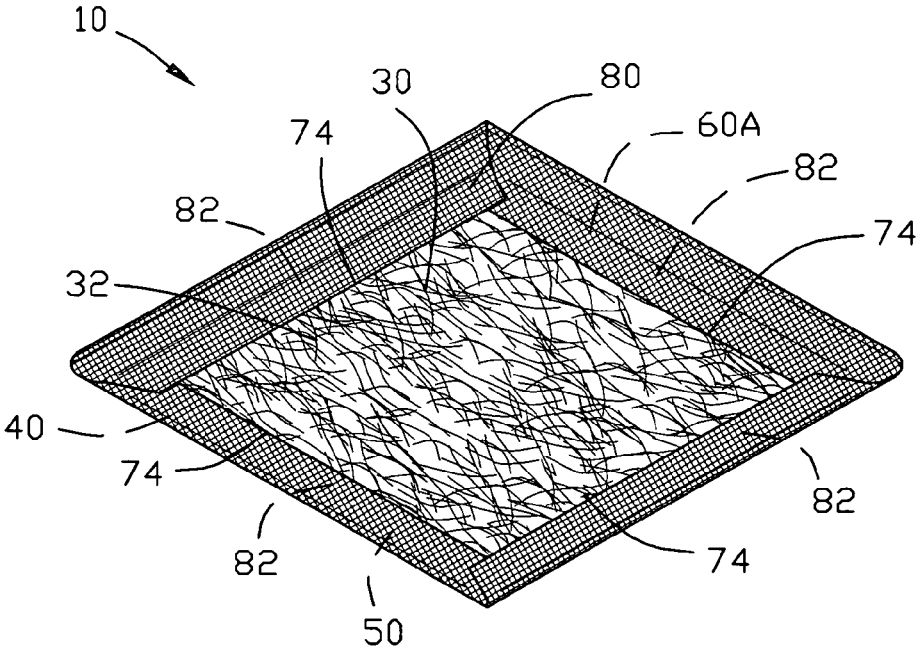
FIG. 13 is a bottom isometric view of FIG. 12.
Figure 14:
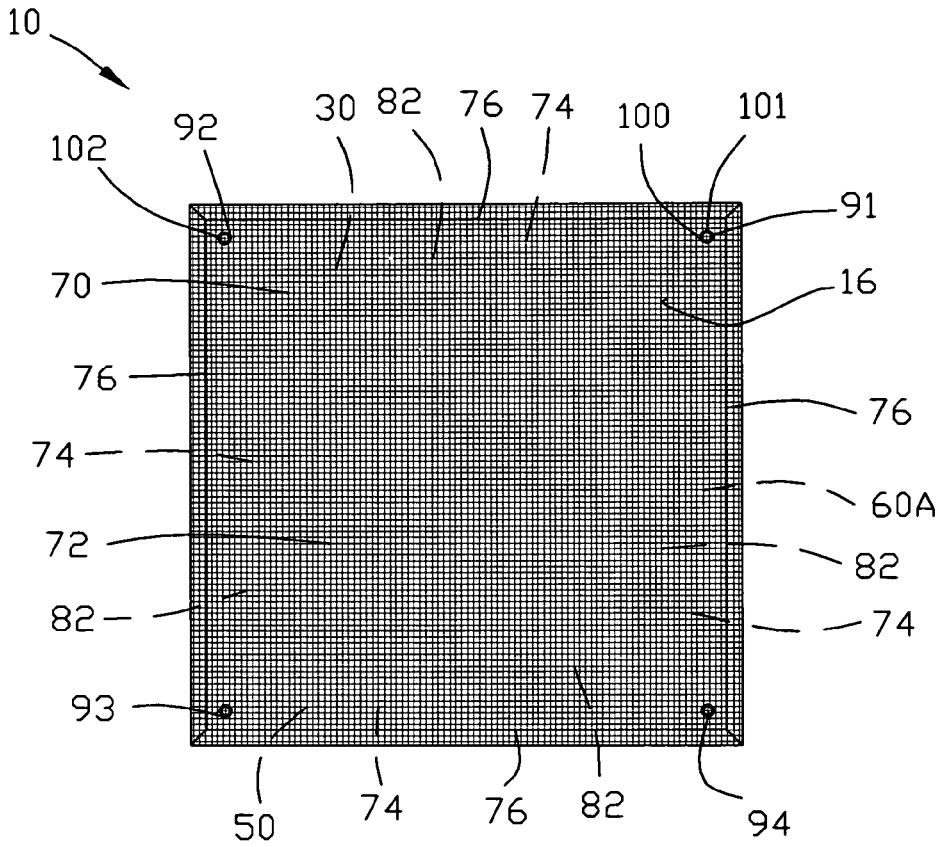
FIG. 14 is a bottom view of FIG. 13 illustrating a sixth step of making the first embodiment of the improved acoustic panel depicting a second face of the sound absorbing member being overlaid with a second covering sheet.

FIGS. 12-14 illustrate further steps in the process of making the improved acoustic panel 10 of the present invention. The improved acoustic panel 10 comprises a porous covering sheet 70 for overlaying the first and second face surfaces 31 and 32 of the sound absorbing member 30. In this example, the porous covering sheet 70 comprises a first and a second covering sheet 71 and 72 for overlaying the first and second face surfaces 31 and 32 of the sound absorbing member 30.

FIG. 12 is view similar to FIG. 10 illustrating a fifth step of making the improved acoustic panel 10 depicting the first face 31 of the sound absorbing member 30 being overlaid with the first covering sheet 71.

FIG. 13 is a bottom isometric view of FIG. 12 illustrating the peripheral edges 74 of the first covering sheet 71 being attached to the second face surface 32 of the sound absorbing member 30. In this example, a peripheral edge 74 of the first covering sheet 71 is attached to the second face 32 of the sound absorbing member 30 by an adhesive 82.

FIG. 14 is a bottom view of FIG. 13 illustrating a sixth step of making the improved acoustic panel 10 depicting a second face 32 of the sound absorbing member 30 being overlaid with the second covering sheet 72. In this example, a peripheral edge 76 of the second covering sheet 72 is attached to the peripheral edge 74 of the first covering sheet 71 by the adhesive 82.

In this example, the porous covering sheet 70 is a porous covering sheet made of a liquid resistant substantially flexible fabric material. Preferably, the porous covering sheet 70 is formed from a synthetic fabric material. In one example of the invention, the porous covering sheet 70 comprises a polyester textile material.

Figure 15:
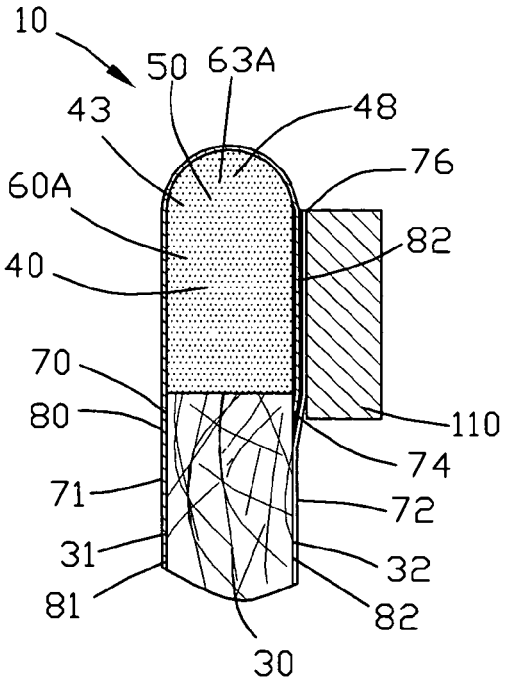
FIG. 15 is an enlarged sectional view along line 15-15 in FIG. 1.

FIG. 15 is an enlarged sectional view along line 15-15 in FIG. 1 illustrating an attachment 80 for securing the porous covering sheet 70 to the water resistant sound absorbing member 30. In one example, the attachment 80 includes adhesive layers 80 for securing the flexible porous covering sheet 70 to the water resistant sound absorbing member 30. In this example, the adhesive layer 80 comprises a first and a second adhesive layer 81 and 82 for securing the first and second flexible porous covering sheet 71 and 72 to the water resistant sound absorbing member 30. Preferably, the adhesive layers 80 are formed from a water resistant adhesive for securing the flexible porous covering sheet 70 to the water resistant sound absorbing member 30.

Figure 16:
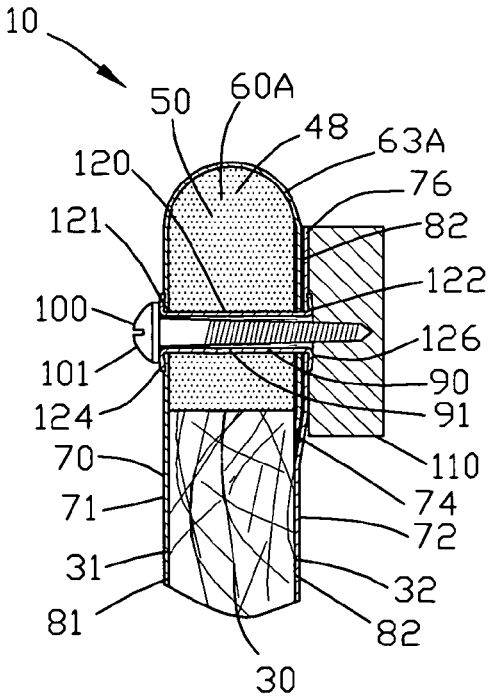
FIG. 16 is an enlarged sectional view along line 16-16 in FIG. 1.

FIG. 16 is an enlarged sectional view along line 16-16 in FIG. 1 illustrating the optional mounting 90 for supporting the improved acoustic panel 10. In this example of the invention, the mounting 90 includes first through fourth bores 91-94 extending through the first through fourth frame portion 61A-64A of the internal frame 60A. The first through fourth bores 91-94 further extend through the first and second covering sheets 71 and 72 overlaying the first and second face surfaces 31 and 32 of the sound absorbing member 30. The internal frame 60A provides the necessary support for enabling a fastener 100 to extend through the bore 91 for mounting the improved acoustic panel 10 to a support 110.

The fastener 100 extends through the bore 90 for mounting the improved acoustic panel 10 to the support 110. In this example of the invention, a fastener 100 comprises a plurality of fasteners 101-104 extending through the plurality of bores 91-94 for mounting the improved acoustic panel 10 to the support 110. The plurality of fasteners 101-104 may be mechanical fasteners of such as screws, bolts, nails or the like. In the alternative, the plurality of fasteners 100 and may be rope, wire or other types of fastening devices.

In this example, each of the mountings 90 includes a metallic sleeve 120 extending between a first and a second end 121 and 122. The metallic sleeve 120 is shown inserted within the first bore 91 to extend through the third frame portion 63A of the internal frame 60A. The first and second ends 121 and 122 of the metallic sleeve 120 includes flares 124 and 126 for engaging the first and second face surfaces 31 and 32 of the sound absorbing member 30 through the first and the second covering sheets 71 and 72. The metallic sleeve 120 adds mechanical strength to the first bore 91 extending through the third frame portion 63A of the internal frame 60A.

Figure 17:
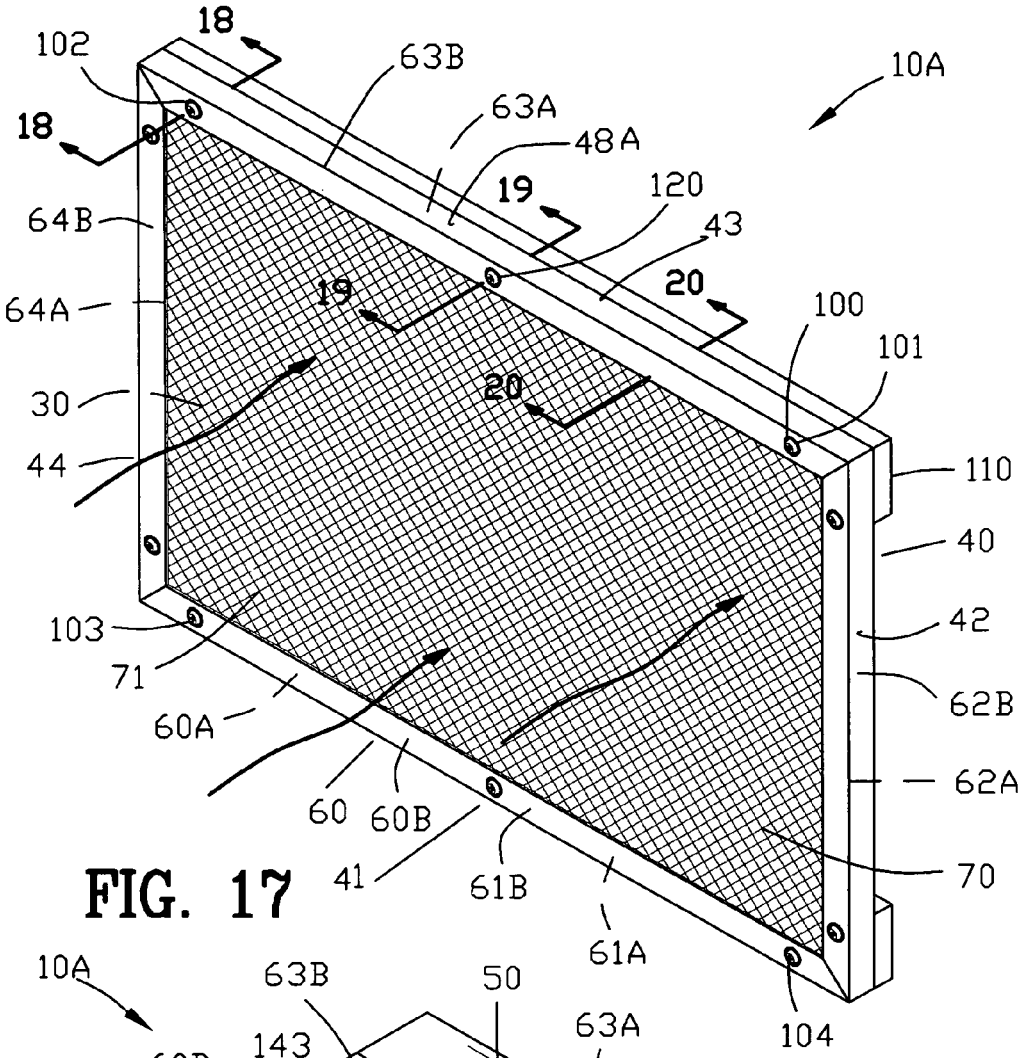
FIG. 17 is an isometric view of a second embodiment of an improved acoustic panel of the present invention installed on a support in an outdoor or a hazardous environment.
Figure 18:
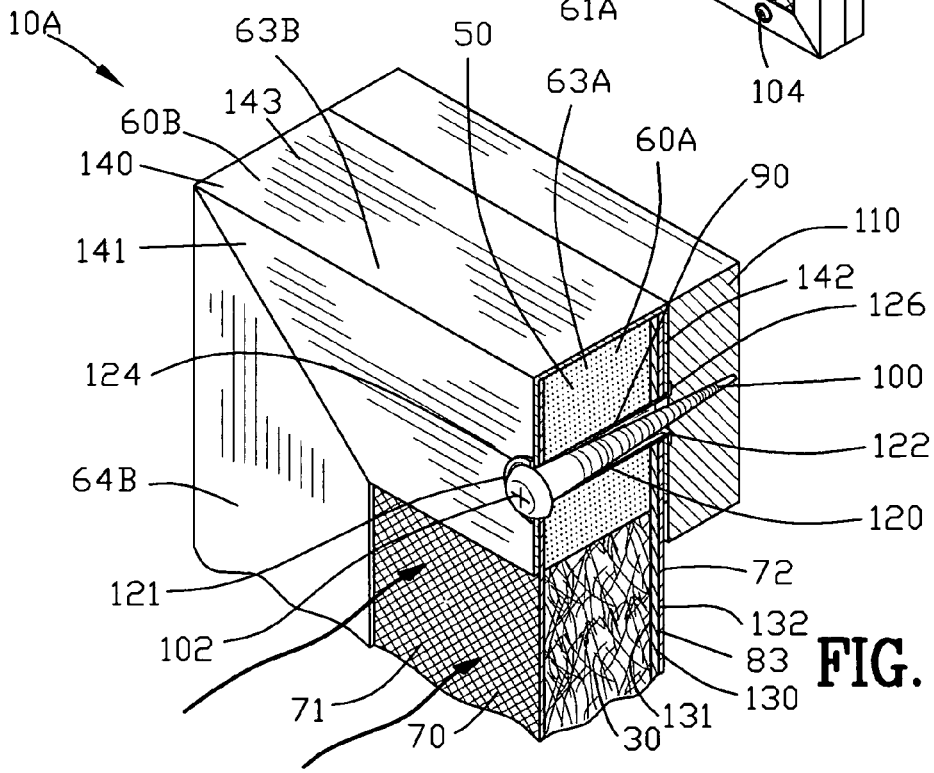
FIG. 18 is an enlarged isometric view along line 18-18 in FIG. 17.

FIGS. 17 and 18 are isometric views of a second embodiment of an improved acoustic panel 10A of the present invention installed on a support 110 in an outdoor or a hazardous environment. In this example the water resistant sound absorbing member 30 comprises a plurality of peripheral edges 40 shown as peripheral edges 41-44 in a rectangular configuration. In this second embodiment of the invention, each of the plurality of peripheral edge 41-44 has a substantially rectangular cross-section 48A.

In this second embodiment of the invention, the support frame 60 of the improved acoustic panel 10A includes an internal frame 60A and an external frame 60B. The internal frame 60A includes a water resistant curable polymeric material 50 impregnated into a portion of each of the plurality of peripheral edges 41-44 of the sound absorbing member 30. The internal frame 60A may be formed in a manner similar to the internal frame 60 shown in FIGS. 1-16.

The external frame 60B is located about the plurality of peripheral edges surfaces 41-44 of the sound absorbing member 30. The external frame 60B includes a rigid material overlying a portion of each of the plurality of peripheral edges 41-44 of the sound absorbing member 30. The external frame 60B overlies the plurality of peripheral edges 41-44 and overlies the internal frame 60A of the sound absorbing member.

The improved acoustic panel 10A includes a water resistant sound blocking member 130 for blocking the transmission of sound through the sound reducing panel. The water resistant sound blocking member 130 comprises a first and a second face surface 131 and 132. The water resistant sound blocking member 130 is affixed to the water resistant sound absorbing member 30. Preferably, the water resistant sound blocking member 130 is affixed to the second face surface 132 of the water resistant sound absorbing member 30 by a third adhesive layer 83.

Figure 19:
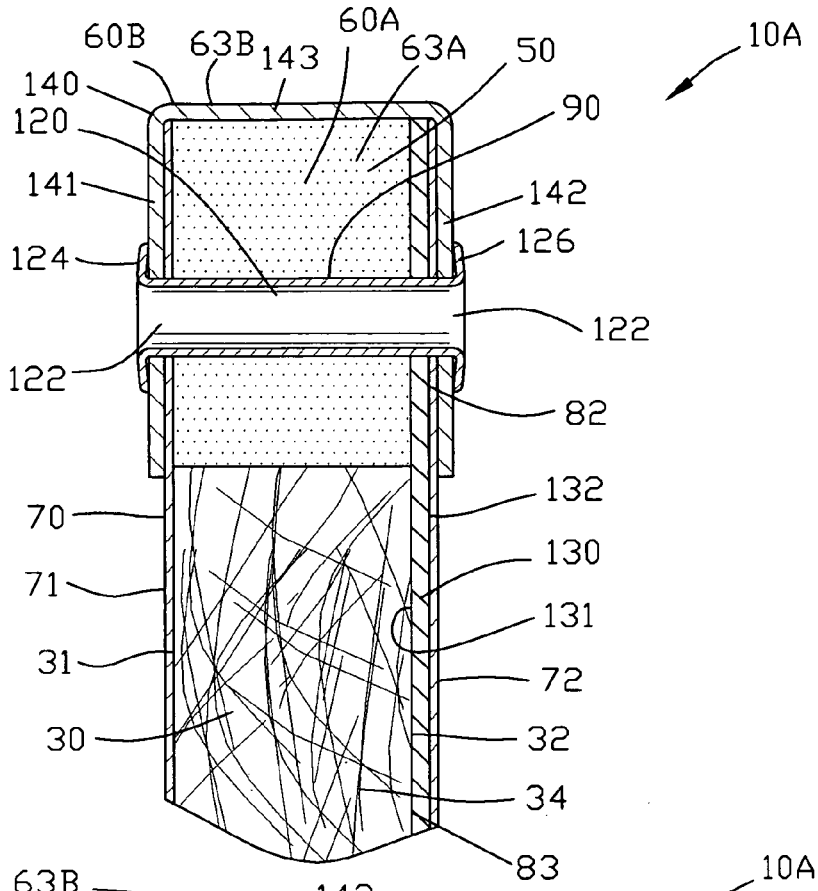
FIG. 19 is an enlarged sectional view along line 19-19 in FIG. 17 with the support being removed.
Figure 20:
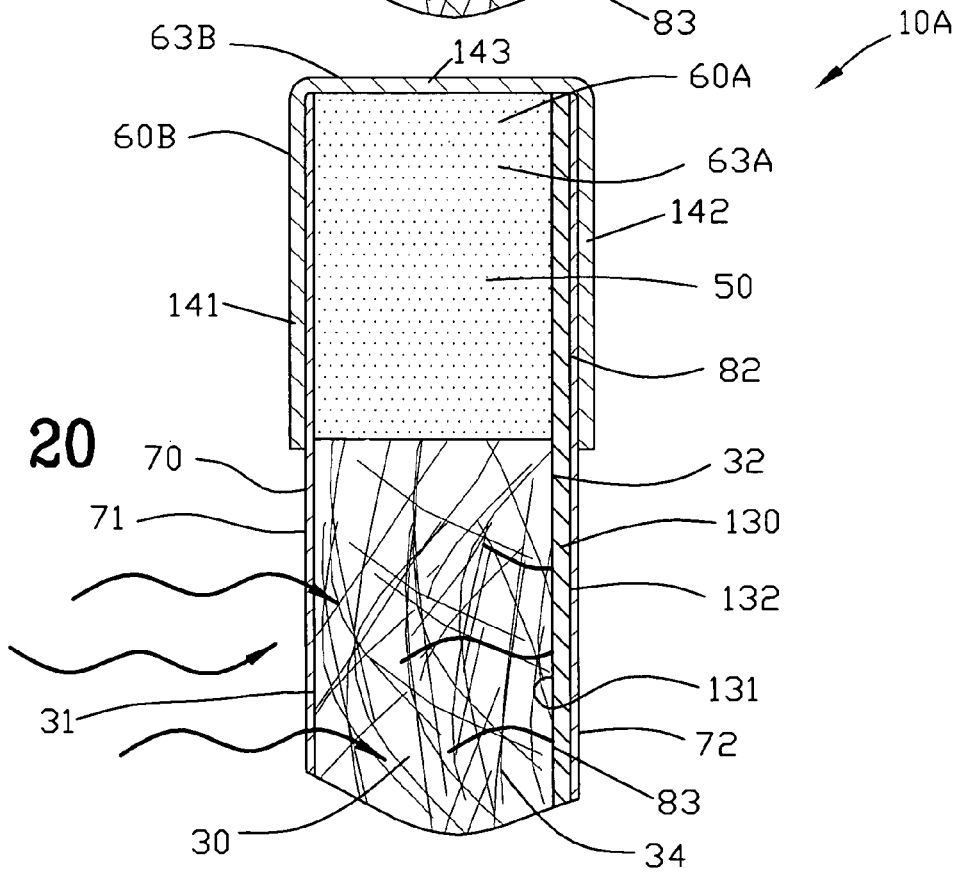
FIG. 20 is an enlarged sectional view along line 20-20 in FIG. 17 with the support being removed.

FIGS. 19 and 20 are enlarged sectional views of the sound reducing panel 10A of FIG. 17 with the support 110 being removed for the purposes of clarity. The external frame 60B is shown as a generally U-shape metallic member 140 located about the plurality of peripheral edges surfaces 41-44 of the sound absorbing member 30. The U-shape metallic member 140 includes a first and a second leg 141 and 142 connected by an intermediate leg 143.

The first and second legs 141 and 142 are disposed adjacent to the first and second face surfaces 31 and 32 of the water resistant sound absorbing member 30. The intermediate leg 143 of the U-shape metallic member 140 is located adjacent to a respective side of the plurality of peripheral edges surfaces 41-44 of the sound absorbing member 30. The external frame 60B maybe secured to the water resistant sound absorbing member 30 by securing the frame sections 61A-64A to one another by suitable means such as mechanical fasteners, welding or any other suitable means.

The first face surface 131 of the water resistant sound blocking member 130 is affixed to the second face surface 32 of the water resistant sound absorbing member 30. The water resistant sound blocking member 130 acts in concert with the water resistant sound absorbing member 30. The water resistant sound absorbing member 30 enables sound entering the first face surface 31 of the sound absorbing member 30 to be absorbed and/or dissipated by the sound absorbing member 30. The water resistant sound blocking member 130 inhibits sound from exiting from the second face surface 32 of the sound absorbing member 30. The water resistant sound blocking member 130 inhibits sound from passing through the sound reducing panel 10A.

In this example, the water resistant sound blocking member 130 comprises a sheet of mineral filled vinyl polymeric material having a thickness of approximately one-eighth of an inch and having a weight equal to or greater than one pound per square foot. Preferably, the water resistant sound blocking member 130, which is a loaded mass vinyl has a sound transmission coefficient greater than 25. A suitable material is sold under the Registered Trademark Acoustiblok by Acoustiblok, Inc. of Tampa, Fla. (www.acoustiblok.com).

Figure 21:
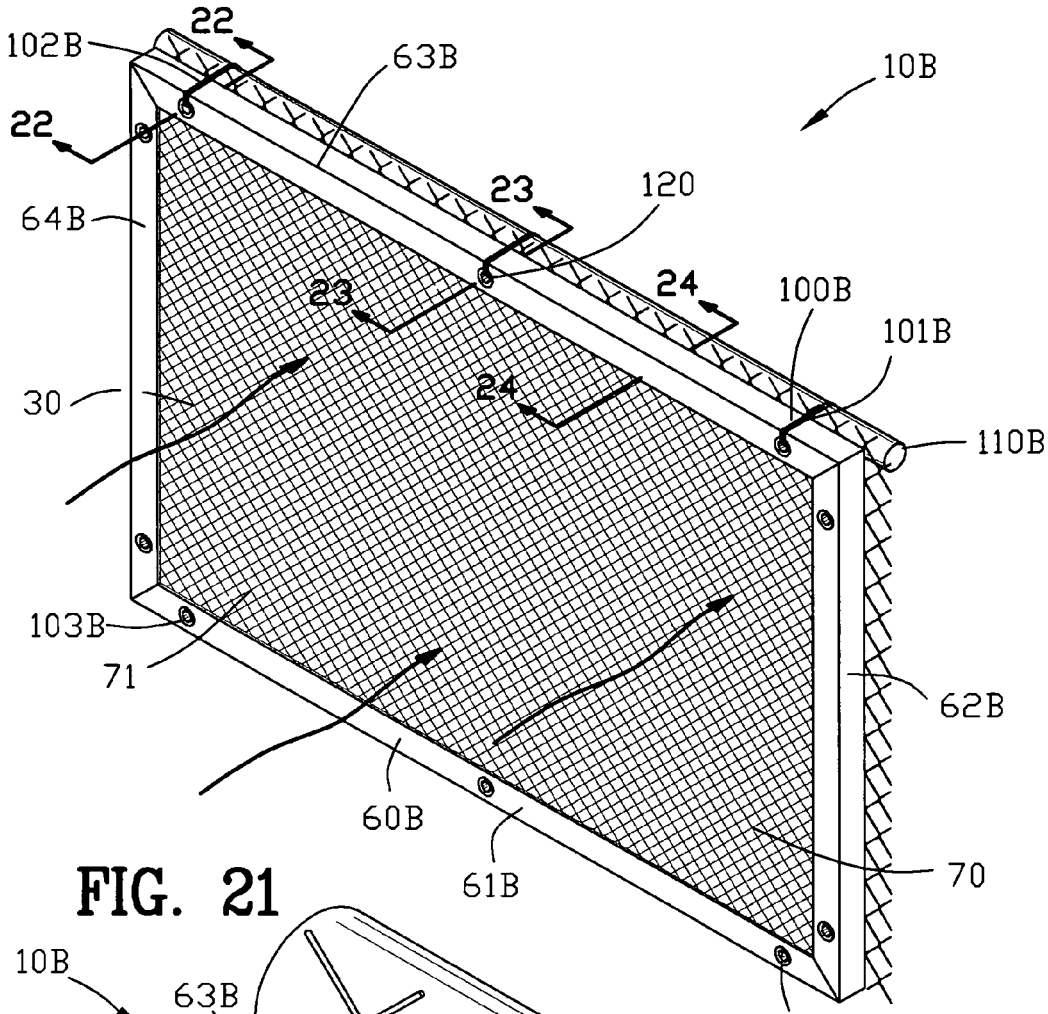
FIG. 21 is an isometric view of a third embodiment of an improved acoustic panel of the present invention installed on a support in an outdoor or a hazardous environment.
Figure 22:
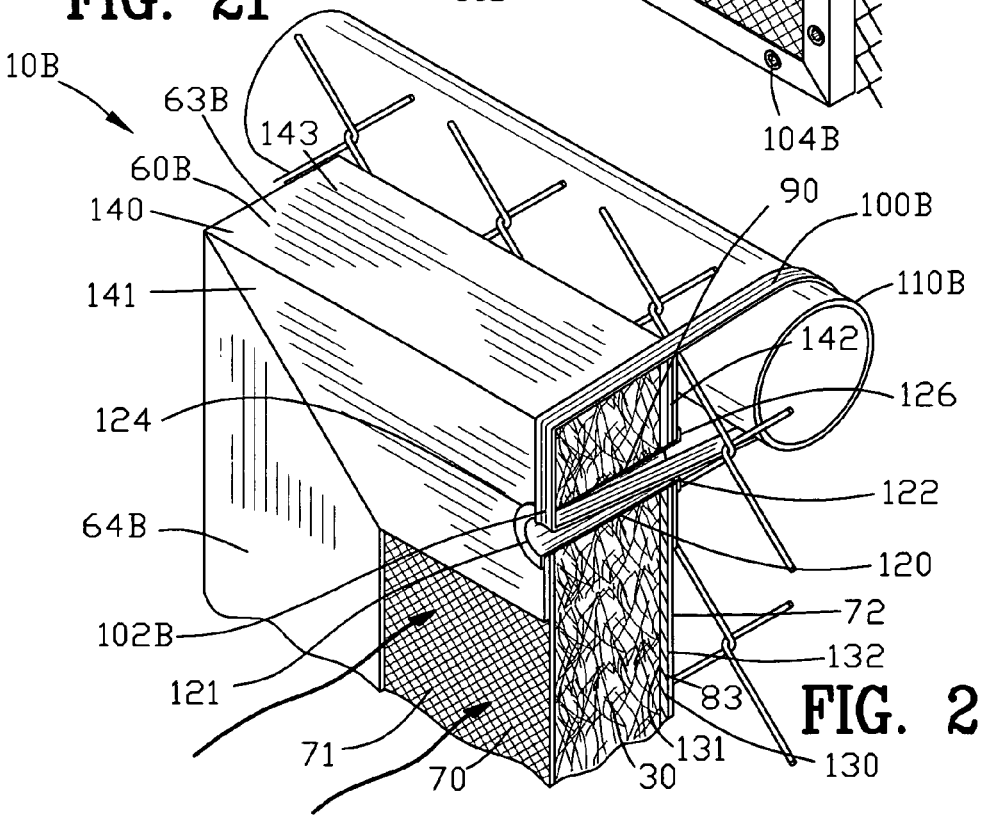
FIG. 22 is an enlarged isometric view along line 22-22 in FIG. 21.

FIGS. 21 and 22 are isometric views of a third embodiment of an improved acoustic panel 10B of the present invention installed on a support 110B in an outdoor or a hazardous environment. In this example, the support 110B is shown as a chain link fence of conventional design. The mounting fasteners 100B are shown as wire, fiber or plastic fasteners for securing the improved acoustic panel 10B to the support 110B. Although the support 110B has been shown as a chain link fence of conventional design, it should be appreciated that numerous other ways and methods may be used for supporting and or hanging or otherwise spending the improved acoustic panel with them and environment.

Figure 23:
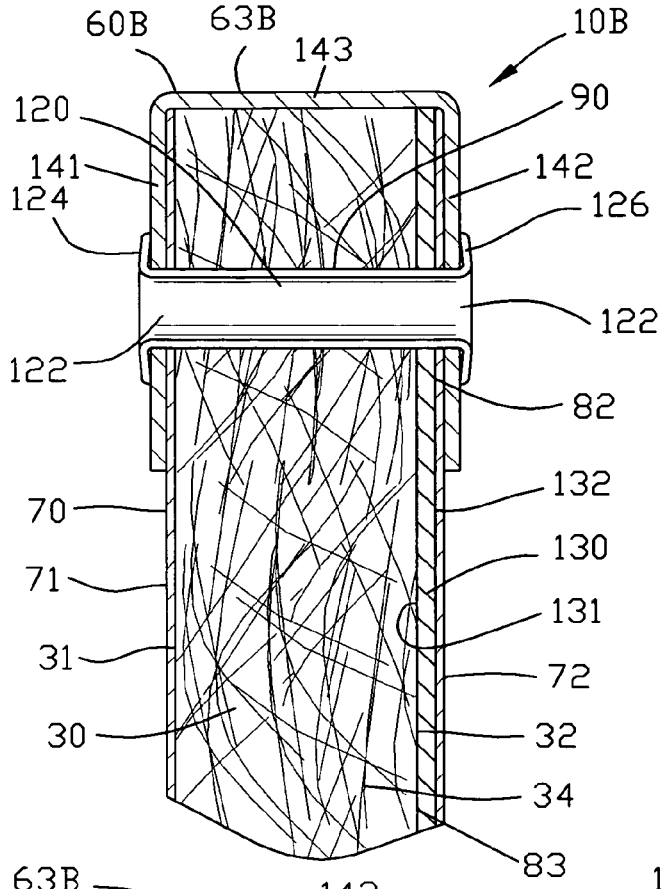
FIG. 23 is an enlarged sectional view along line 23-23 in FIG. 21 with the support being removed.
Figure 24:
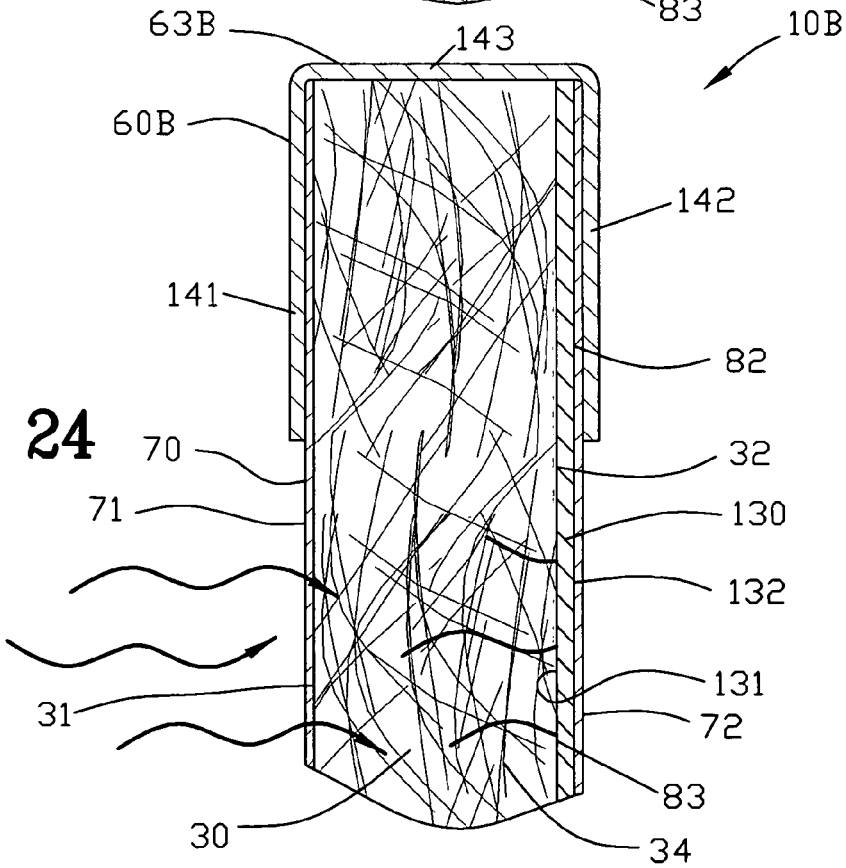
FIG. 24 is an enlarged sectional view along line 24-24 in FIG. 21 with the support being removed.

FIGS. 23 and 24 are enlarged sectional views of the sound reducing panel 10B of FIG. 21 with the support 110B being removed for the purposes of clarity. In this third embodiment of the invention, the support frame 60 of the improved acoustic panel 10B includes an external frame 60B. The improved acoustic panel 10B has no internal frame. The external frame 60B is located about the plurality of peripheral edges surfaces 41-44 of the sound absorbing member 30. The external frame 60B includes a rigid material overlying a portion of each of the plurality of peripheral edges 41-44 of the sound absorbing member 30.

Figure 25:
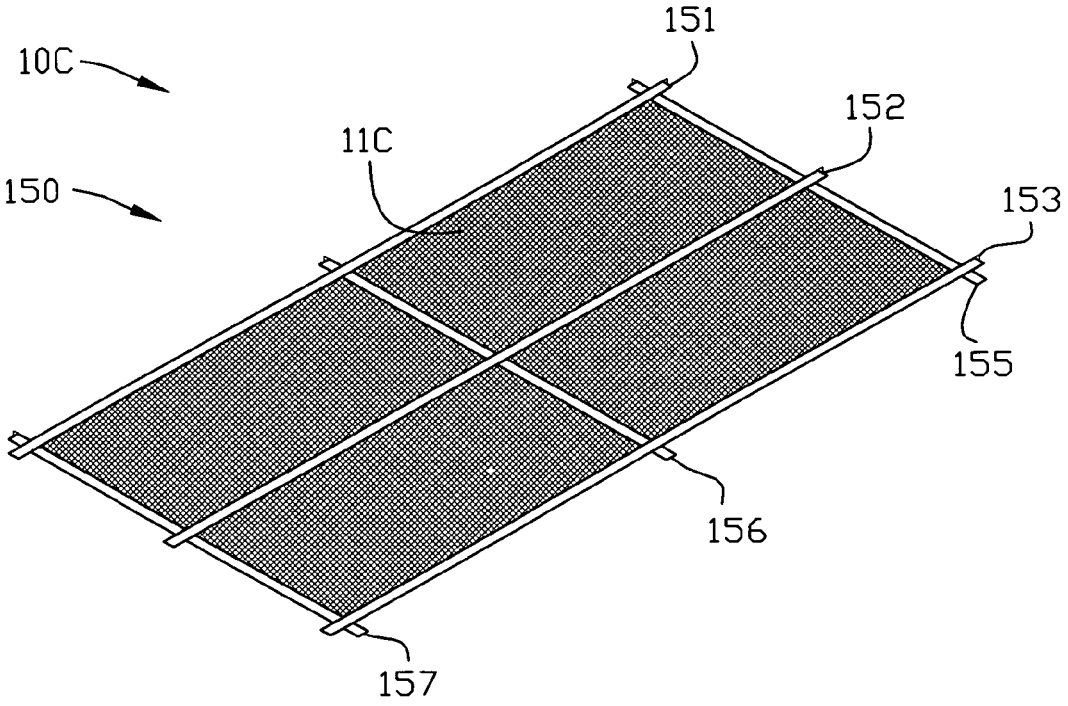
FIG. 25 is an isometric bottom view of a fourth embodiment of an improved acoustic panel of the present invention installed on conventional suspended ceiling frame.
Figure 26:
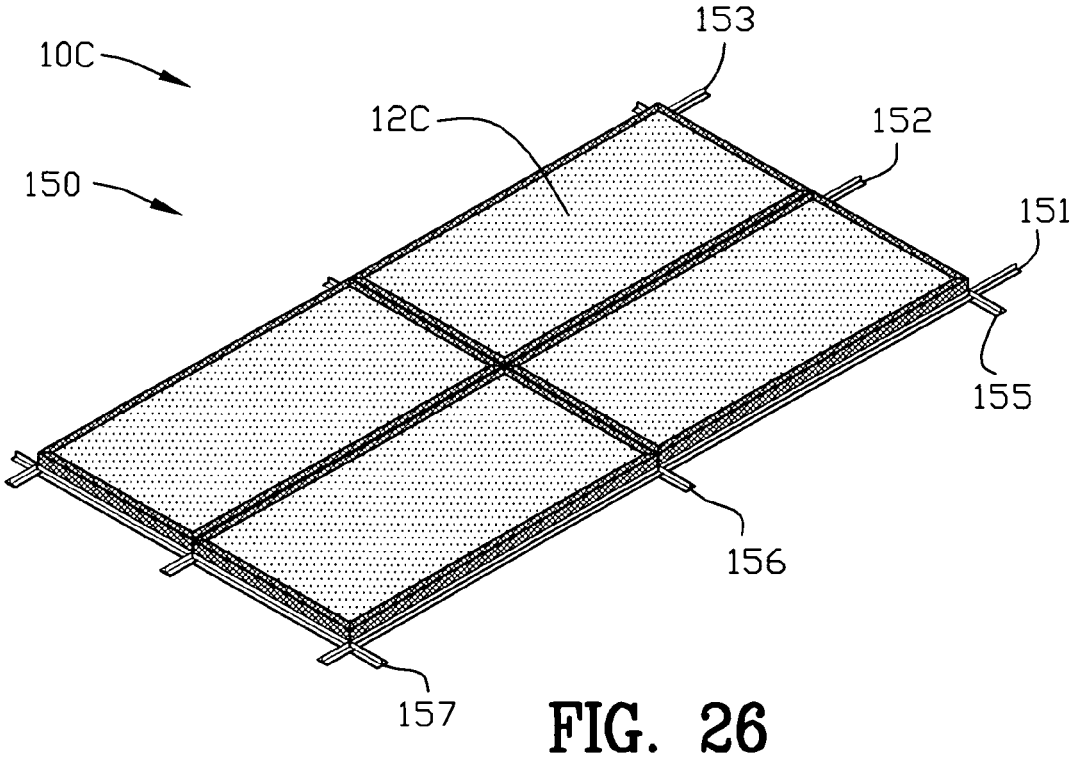
FIG. 26 is an isometric top view of FIG. 25.

FIGS. 25 and 26 are isometric bottom and top views of a fourth embodiment of plural improved acoustic panels 10C of the present invention installed on conventional suspended ceiling frame 150.

The conventional suspended ceiling frame 150 is shown having a plurality of T-bars 151-153 and a plurality of cross T-bars 155-157. The plural improved acoustic panels 10C are installed within the suspended ceiling frame 150 in an identical manner as the installation of a conventional ceiling panel (not shown) as should be well known to those skilled in the art.

Figure 27:
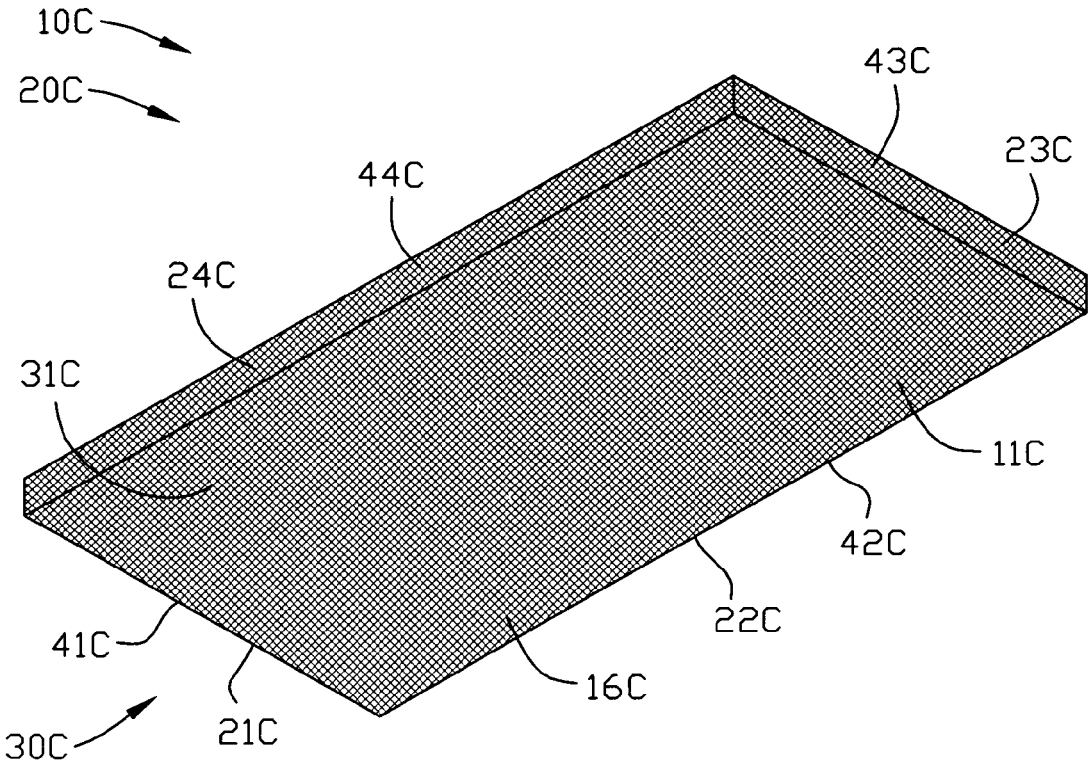
FIG. 27 is an enlarged isometric bottom view of the improved acoustic panel of FIG. 25.
Figure 28:
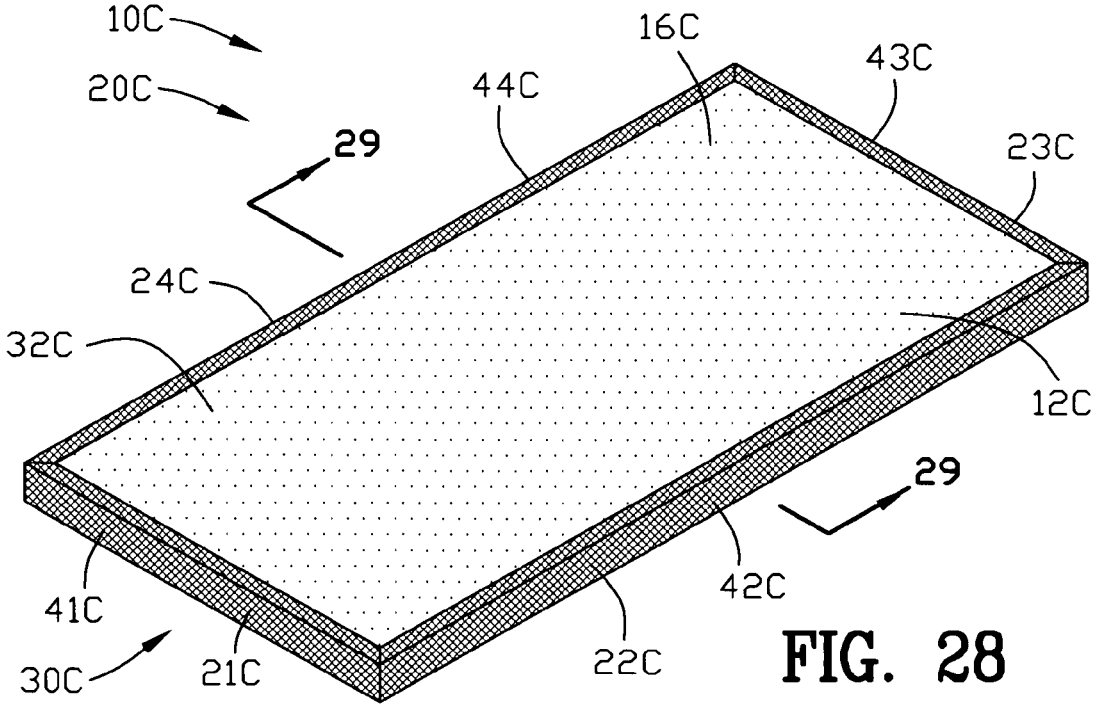
FIG. 28 is an enlarged isometric top view of the improved acoustic panel of FIG. 26.

FIGS. 27 and 28 are enlarged isometric bottom and top views of the improved acoustic panel 10C of FIGS. 25 and 26. The improved acoustic panel 10C comprises a first and a second face surface 11C and 12C. Each of the first and second face surfaces 11C and 12C includes a multiplicity of pores 16C for receiving sound and/or noise from the environment. The improved acoustic panel 10C comprises a plurality of peripheral edges 20C shown as peripheral edges 21C-24C.

The improved acoustic panel 10C comprises a sound absorbing member 30C having a first and a second face surface 31C and 32C. The improved acoustic panel 10C is formed from a multiplicity of fibers 34C defining a multiplicity of pores 36C between adjacent fibers 34C. Preferably, the sound absorbing member 30C is formed from one to two inch thick fiberglass fiberboard having a density of 6 pounds per square foot. The sound absorbing member 30C is defined by a plurality of peripheral edges 40C shown as peripheral edges 41C-44C. Each of the plurality of peripheral edge 41C-44C has a substantially rectangular cross-section 48C.

Figure 29:
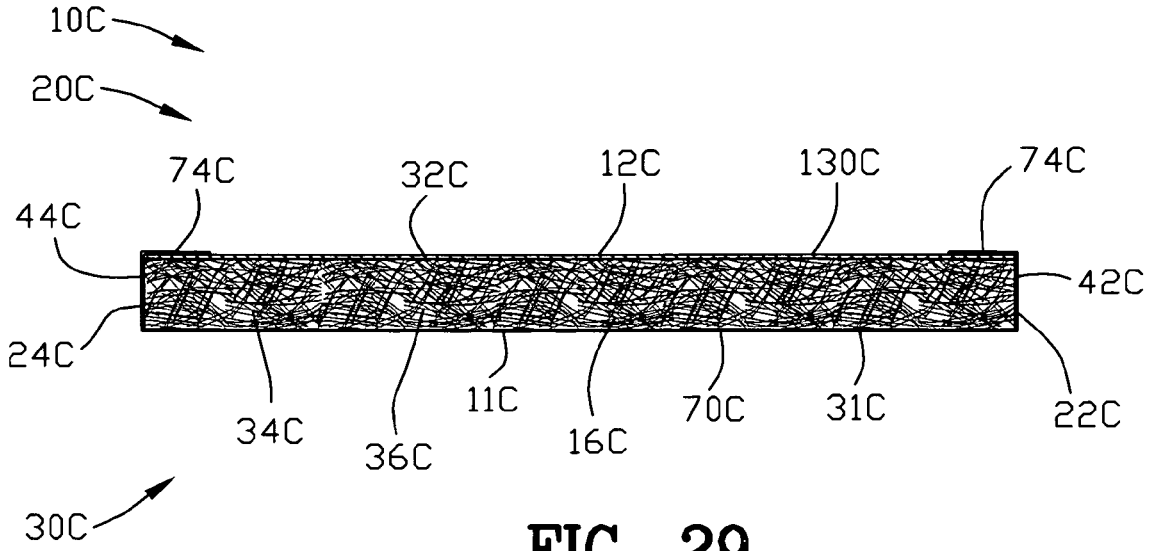
FIG. 29 is an enlarged sectional view along line 29-29 in FIG. 28.

FIG. 29 is a sectional view of the improved acoustic panel of FIGS. 27 and 28. The improved acoustic panel 10C comprises a porous covering sheet 70C for overlaying the first surface 31C of the sound absorbing member 30C. The porous covering sheet 70C is made of a substantially flexible, fabric material as heretofore described. Preferably, the porous covering sheet 70C is a fire retardant acoustically transparent material.

The porous covering sheet 70C overlays the first face 31C of the sound absorbing member 30C with the peripheral edges 74C of the porous covering sheet 70C extending to overlay outer peripheral portions of the second face surface 32C of the sound absorbing member 30C.

Figure 30:
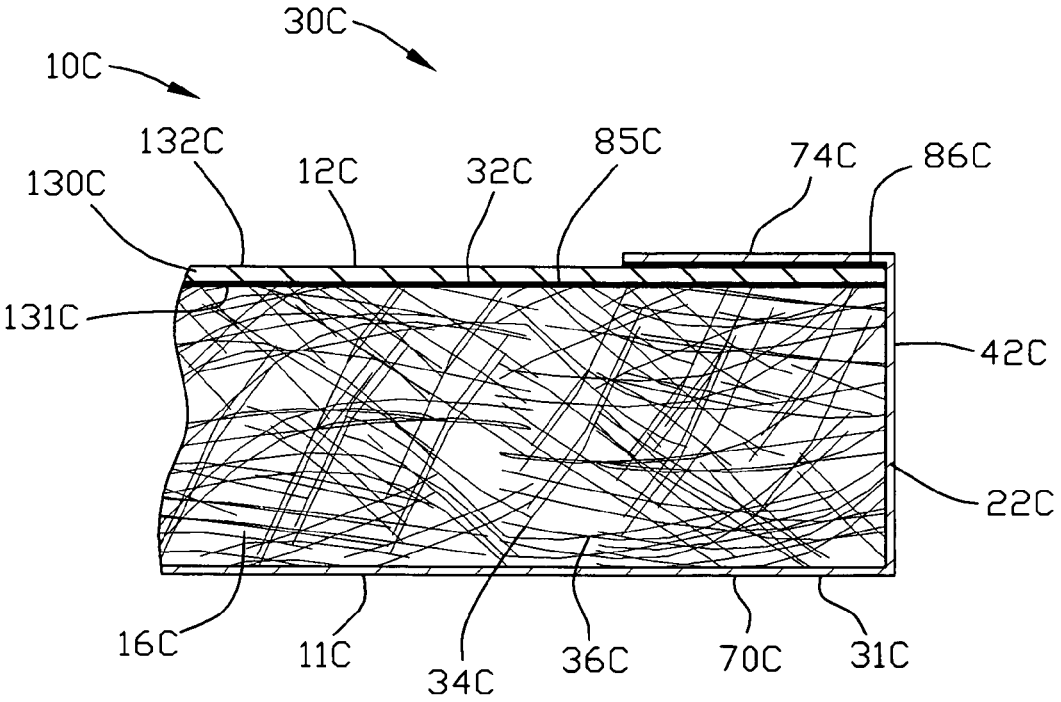
FIG. 30 is a magnified view of a portion of FIG. 29.

FIG. 30 is a magnified view of a portion of FIG. 29. The improved acoustic panel 10C includes a sound blocking member 130C for blocking the transmission of sound through the sound reducing panel 10C. The sound blocking member 130C comprises a first and a second face surface 131C and 132C. The first face surface 131C of the sound blocking member 130C is positioned adjacent to the second face surface 32C of the sound absorbing member 30C.

The sound blocking member 130C acts in concert with the sound absorbing member 30C. The sound absorbing member 30C enables sound entering the first face surface 31C of the sound absorbing member 30C to be absorbed and/or dissipated by the sound absorbing member 30C. The sound blocking member 130C inhibits sound from exiting from the second face surface 32C of the sound absorbing member 30C.

In this embodiment, the first face surface 131C of the sound blocking member 130C is affixed to the second face surface 32C of the sound absorbing member 30C by an adhesive layer 85C. The peripheral edges 74C of the porous covering sheet 70C are affixed to the second face surface 132C of the sound blocking member 130C by an adhesive layer 86C.

Figure 31:
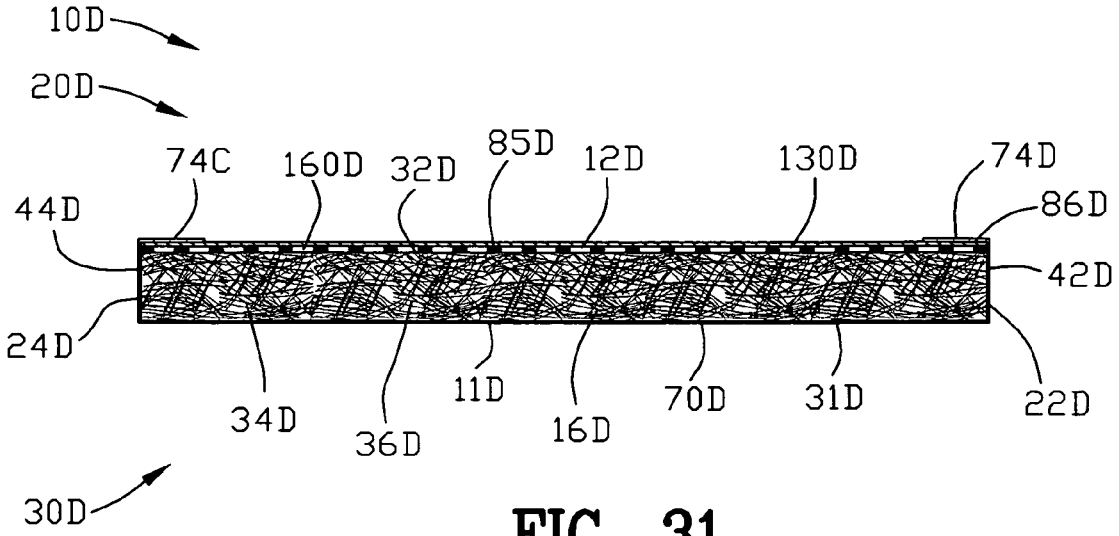
FIG. 31 is a view similar to FIG. 29 illustrating a fifth embodiment of the invention.

FIG. 31 is a view similar to FIG. 29 illustrating a fifth embodiment of the improved acoustic panel 10D of the present invention. The improved acoustic panel 10D comprises a first and a second face surface 11D and 12D having a multiplicity of pores 16D for receiving sound and/or noise from the environment. The improved acoustic panel 10D comprises a plurality of peripheral edges 20D including peripheral edges 22D and 24D.

The improved acoustic panel 10D comprises a sound absorbing member 30D having a first and a second face surface 31D and 32D. The sound absorbing member 30D is defined by a plurality of peripheral edges 40D including peripheral edges 42D and 44D.

The improved acoustic panel 10D comprises a porous covering sheet 70D for overlaying the first surface 31D of the sound absorbing member 30D. The porous covering sheet 70D overlays the first face 31D of the sound absorbing member 30D with peripheral edges 74D of the porous covering sheet 70D extending to overlay outer peripheral portions of the second face surface 32D of the sound absorbing member 30D.

Figure 32:
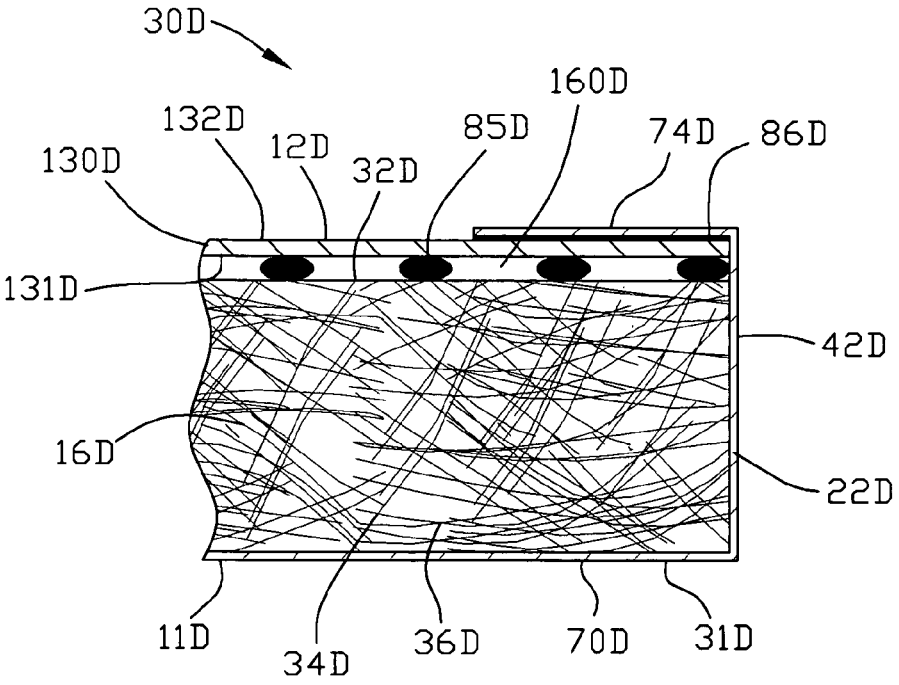
FIG. 32 is a magnified view of a portion of FIG. 31.

FIG. 32 is a magnified view of a portion of FIG. 30. The improved acoustic panel 10D includes a sound blocking member 130D for blocking the transmission of sound through the sound reducing panel 10D. The sound blocking member 130D comprises a first and a second face surface 131D and 132D with the first face surface 131D being positioned adjacent to the second face surface 32D of the sound absorbing member 30D.

In this embodiment, the first face surface 131D of the sound blocking member 130D is displaced from the second face surface 32D of the sound absorbing member 30D defining a space 160D. The space 160D decouples the sound blocking member 130D from the sound absorbing member 30D. The space 160D reduces the transfer of any sound, noise or other vibration from the sound absorbing member 30D to the sound blocking member 130D.

The first face surface 131D of the sound blocking member 130D is displaced from the second face surface 32D of the sound absorbing member 30D by a matrix of thick adhesive projections 85D forming the space 160D. In one embodiment, the matrix of thick adhesive projections 85D may be formed as a pattern of a multiplicity of longitudinal extending thick adhesive projections 85D shown in cross-section in FIG. 32. In another embodiment, the matrix of the thick adhesive projections 85D may be formed as a pattern of a multiplicity of individual regions or islands of the thick adhesive projections 85D shown in cross-section in FIG. 32.

The matrix of thick adhesive projections 85D occupies a minor surface area of the second face surface 32D of the sound absorbing member 30D for decoupling a major surface area from the sound blocking member 130D. Preferably, the matrix of thick adhesive projections 85D space the sound blocking member 130D from the sound absorbing member 30D by a thickness of one-quarter to one-half inch. It should be appreciated that numerous other patterns of matrix of thick adhesive projections 85D or combinations thereof may be used to form the space 160D.

Figure 33:
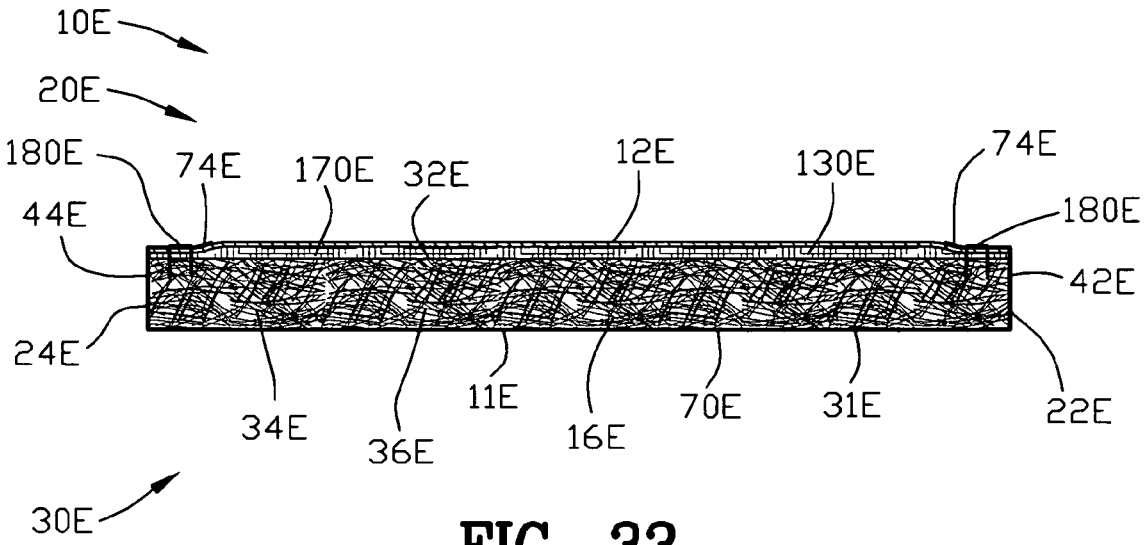
FIG. 33 is a view similar to FIG. 29 illustrating a sixth embodiment of the invention.

FIG. 33 is a view similar to FIG. 29 illustrating a sixth embodiment of the improved acoustic panel 10E of the present invention. The improved acoustic panel 10E comprises a first and a second face surface 11E and 12E having a multiplicity of pores 16E for receiving sound and/or noise from the environment. The improved acoustic panel 10E comprises a plurality of peripheral edges 20E including peripheral edges 22E and 24E.

The improved acoustic panel 10E comprises a sound absorbing member 30E having a first and a second face surface 31E and 32E. The sound absorbing member 30E is defined by a plurality of peripheral edges 40E including peripheral edges 42E and 44E.

The improved acoustic panel 10E comprises a porous covering sheet 70E for overlaying the first surface 31E of the sound absorbing member 30E. The porous covering sheet 70E overlays the first face 31E of the sound absorbing member 30E with peripheral edges 74E of the porous covering sheet 70E extending to overlay outer peripheral portions of the second face surface 32E of the sound absorbing member 30E.

Figure 34:
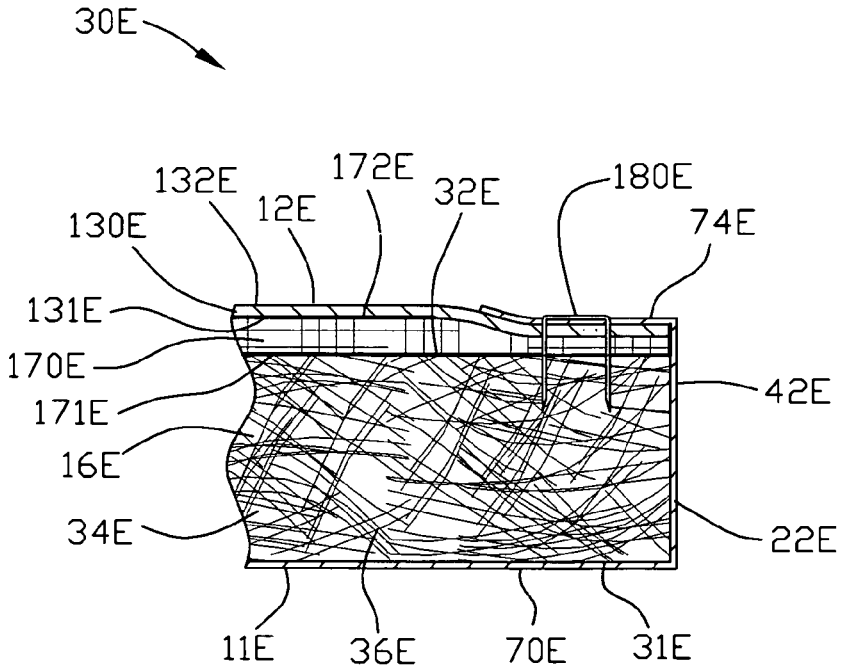
FIG. 34 is a magnified view of a portion of FIG. 33.

FIG. 34 is a magnified view of a portion of FIG. 33. The improved acoustic panel 10E includes a sound blocking member 130E for blocking the transmission of sound through the sound reducing panel 10E. The sound blocking member 130E comprises a first and a second face surface 131E and 132E with the first face surface 131E being positioned adjacent to the second face surface 32E of the sound absorbing member 30E.

In this embodiment, the first face surface 131E of the sound blocking member 130E is displaced from the second face surface 32E of the sound absorbing member 30E defining a space 160E. The space 160E decouples the sound blocking member 130E from the sound absorbing member 30E. The space 160E reduces the transfer of any sound, noise or other vibration from the sound absorbing member 30E to the sound blocking member 130E.

The first face surface 131E of the sound blocking member 130E is displaced from the second face surface 32E of the sound absorbing member 30E by a layer of a spacing material 170E. The spacing material 170E comprises a first and a second face surface 171E and 172E with the first face surface 171E being positioned adjacent to the second face surface 32E of the sound absorbing member 30E.

The first face surface 131E of the sound blocking member 130E positioned adjacent to the second face surface 172E of the spacing material 170E. The peripheral edges 74E of the porous covering sheet 71E positioned adjacent to the second face surface 132E of the sound blocking member 130E.

Preferably, the spacing material 170E comprises a semi-rigid sheet material having a thickness of 0.5 to 1.0 inch and having of density less than the density of the sound absorbing member 30E. One material suitable for use as the spacing material 170E is ⅞ inch production glass also referred to as blue fiberglass filter material manufactured by Flanders Precisionaire.

In this embodiment, a mechanical fastener shown as a staple 180E, extends through the peripheral edges 74E of the porous covering sheet 71E, the sound blocking member 130E and spacing material 170E to fasten with the sound absorbing member 30E. In one example, 1.5 inch staples were used to affix the peripheral edges 74E of the porous covering sheet 71E and the sound blocking member 130E and spacing material 170E to the sound absorbing member 30E.

In the alternative, adhesive layers (not shown) maybe used to secure the peripheral edges 74E of the porous covering sheet 71E, the sound blocking member 130E and spacing material 170E to the sound absorbing member 30E in a manner heretofore described.

Figure 35:
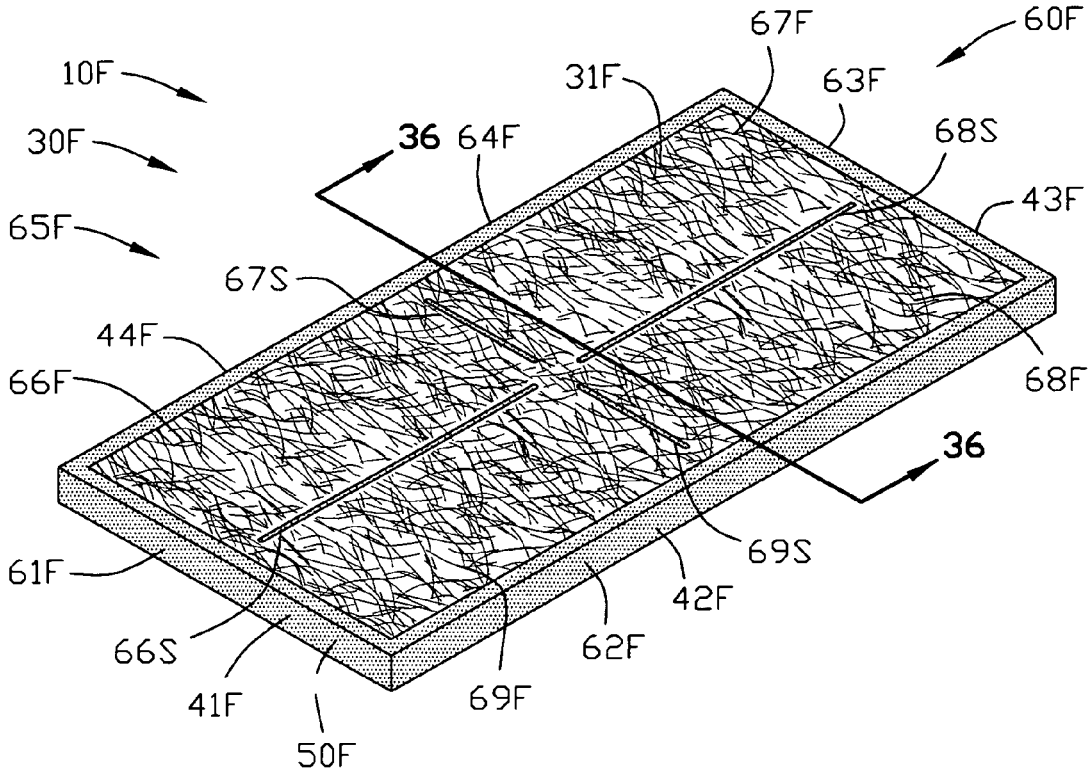
FIG. 35 is an isometric view of an acoustic absorbing material panel suitable for forming a seventh embodiment of the invention.

FIG. 35 is an isometric top view of a sound absorbing member 30F suitable for forming a seventh embodiment of an improved acoustic panel 10F of the invention. The sound absorbing member 30F comprises a first and a second face surface 31F and 32F and a plurality of peripheral edges 41F-44F.

The sound absorbing member 30F includes an internal frame 60F comprising first through fourth frame portion 61F-64F. The internal frame 60F is formed by impregnating a curable polymeric material 50F into the peripheral edges 41F-44F of the sound absorbing member 30F as previously described. The internal frame 60F provides rigidity to the peripheral edges 41F-44F of the sound absorbing member 30F.

The sound absorbing member 30F includes an inner frame 65F comprising first through fourth inner frame portions 66F-69F. A curable polymeric material 50F is poured into slots 66S-49S cut in the sound absorbing member 30F to form the inner frame 65F. The inner frame 60F provides rigidity to the inner region of the sound absorbing member 30F and inhibits deflection or sagging due to the weight of the sound blocking member 130F.

Figure 36:
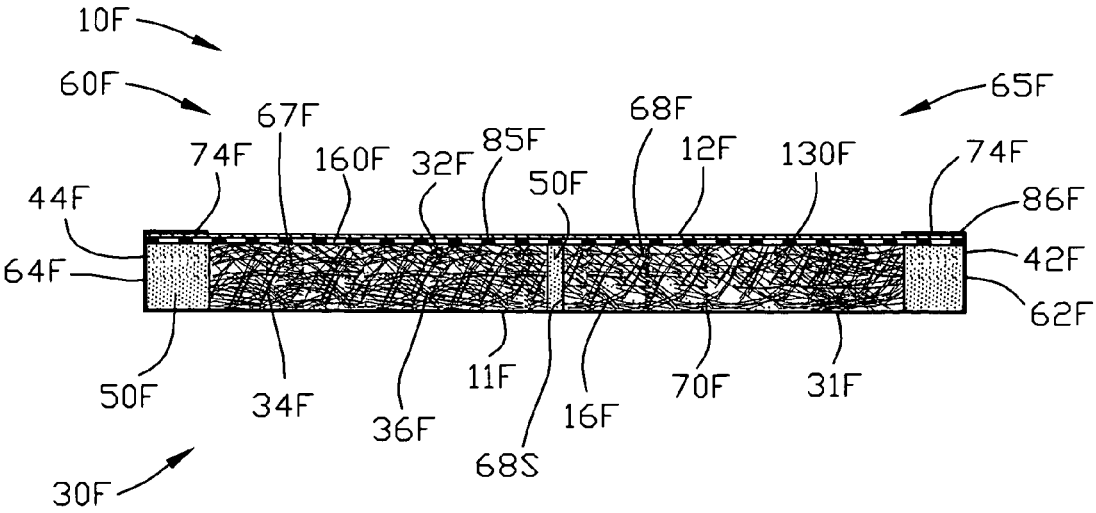
FIG. 36 illustrates a curable material located into portions of the acoustic absorbing material panel to form an inner frame.

FIG. 36 is an enlarged sectional view illustrating an improved acoustic panel 10F formed with the sound absorbing member 30F of FIG. 35. The improved acoustic panel 10F comprises the sound absorbing member 30F, the porous covering sheet 70F and the sound blocking member 130F as described with reference to FIGS. 31 and 32.

Figure 37:
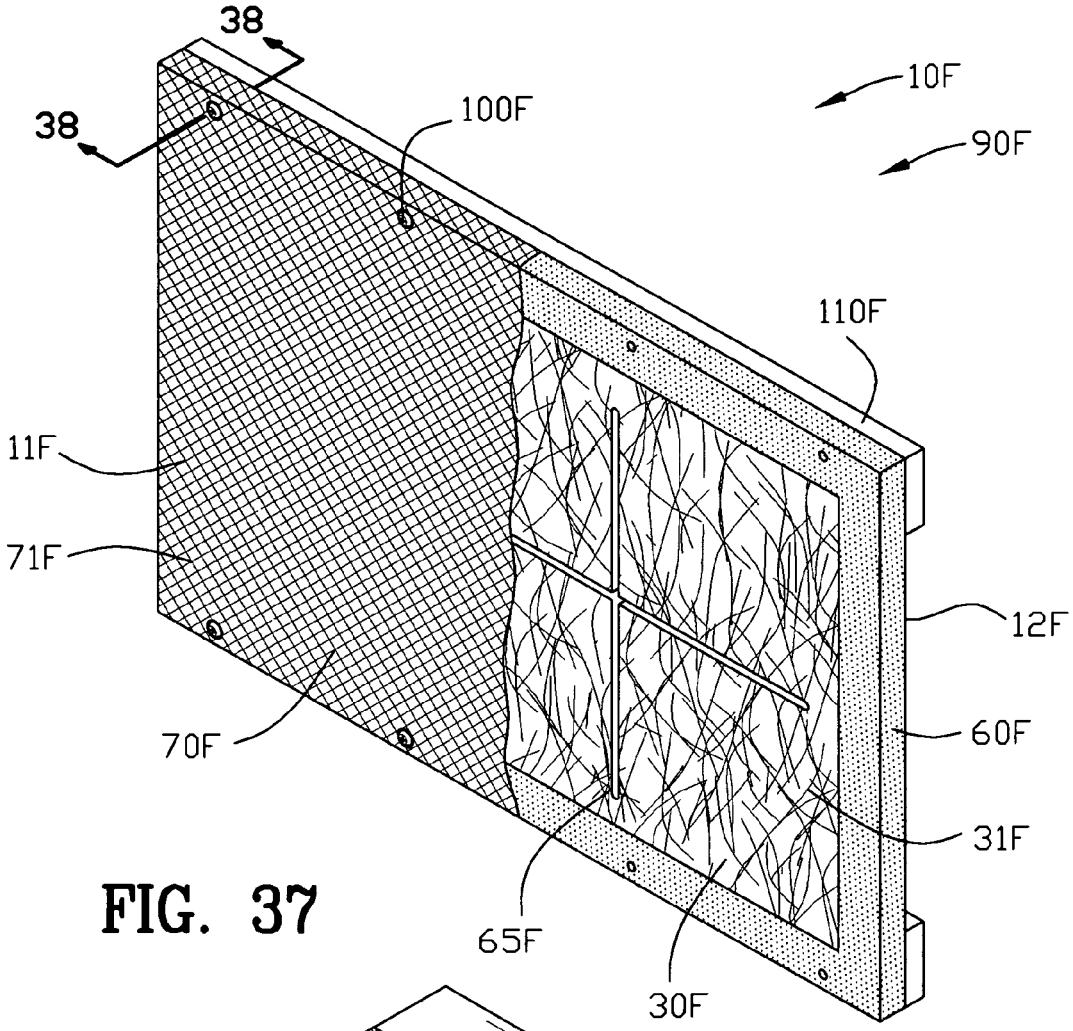
FIG. 37 illustrates the mounting of the improved acoustic panel of FIG. 36.
Figure 38:
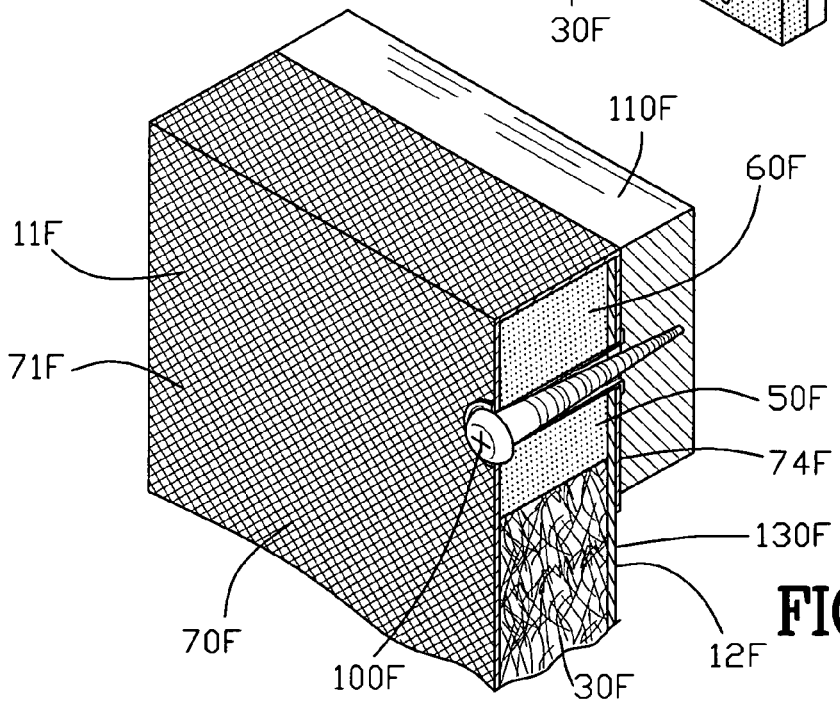
FIG. 38 is a magnified view of a portion of FIG. 37.

FIGS. 37 and 38 illustrate a mounting 90F for securing the improved acoustic panel 10F of FIGS. 35 and 36. In this example, the mounting 90F includes a plurality of mechanical fasteners 100F extending through the internal frame 60F into a support 110F for affixing the improved acoustic panel 10F. In the alternative, the mechanical fasteners 100F may other types of fastening devices as should be well known to those skilled in the art.

Figure 39:
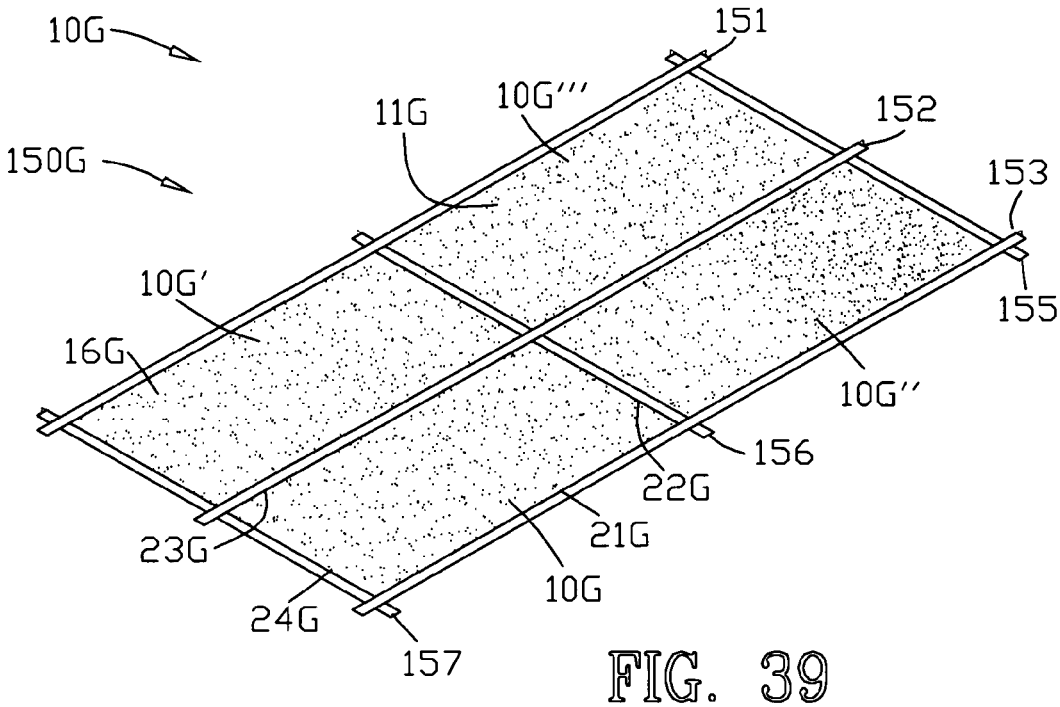
FIG. 39 is an isometric bottom view of a eighth embodiment of an improved acoustic panel of the present invention installed on conventional suspended ceiling frame.
Figure 40:
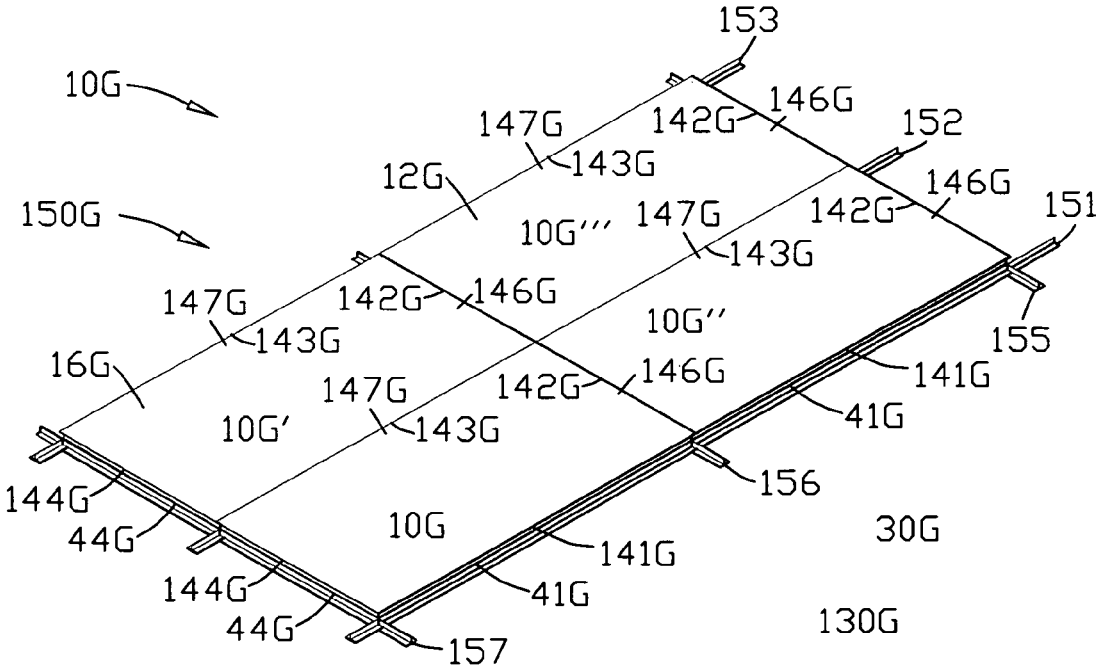
FIG. 40 is an isometric top view of FIG. 39.

FIGS. 39 and 40 are isometric bottom and top views of an eighth embodiment of plural improved acoustic panels 10G-10G''' of the present invention installed on conventional suspended ceiling frame 150G. The conventional suspended ceiling frame 150G is shown having a plurality of T-bars 151G-153G and a plurality of cross T-bars 155G-157G.

Each of the improved acoustic panels 10G-10G''' comprises a first and a second face surface 11G and 12G having a multiplicity of pores 16G for receiving sound and/or noise from the environment. The improved acoustic panels 10G-10G''' comprises a plurality of peripheral edges 20G shown as peripheral edges 21G-24G.

Figure 41:
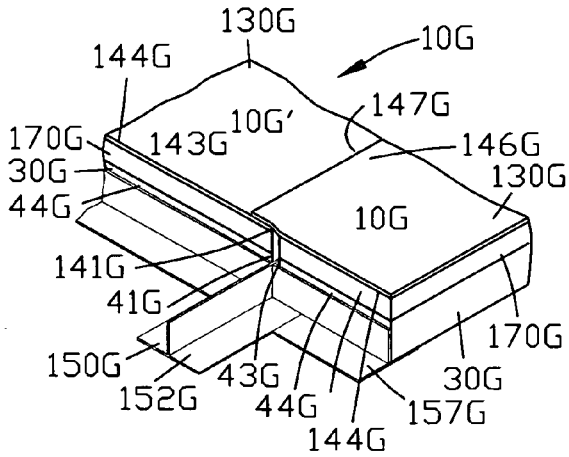
FIG. 41 is a magnified view of a portion of FIG. 40.
Figure 42:
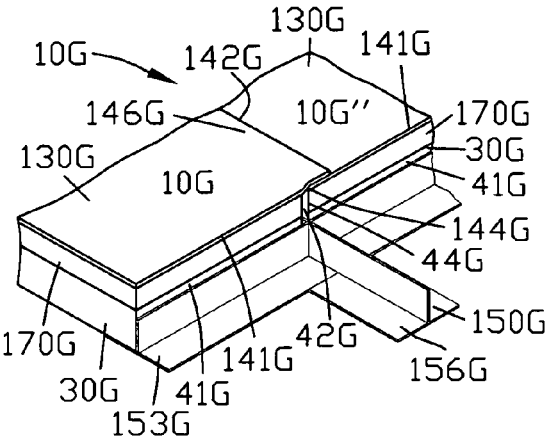
FIG. 42 is a magnified view of a portion of FIG. 40.

FIGS. 41 and 42 are magnified views of a portion of FIG. 40. The improved acoustic panels 10G and 10G' comprise sound absorbing members 30G having plurality of peripheral edges 41G-44G. In this embodiment of the invention, the improved acoustic panels 10G and 10G' is shown as a conventional sound absorbing ceiling tile such as an Armstrong Optima Open Plan ceiling tile.

Figure 43:
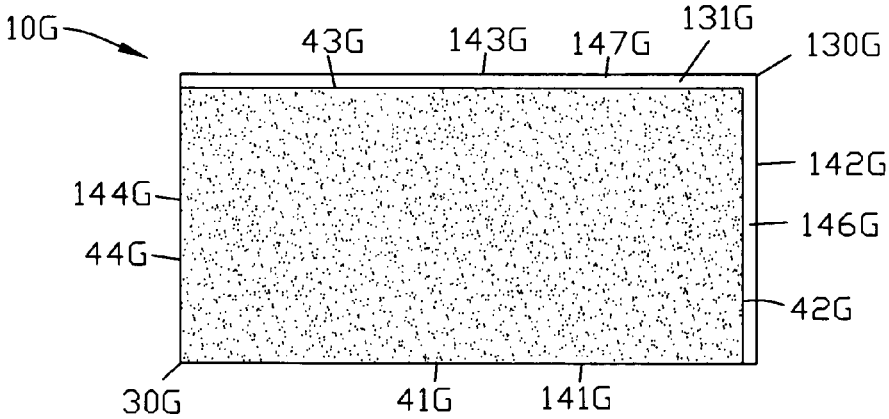
FIG. 43 is an enlarged isometric bottom view of one of the improved acoustic panel of FIG. 39.
Figure 44:
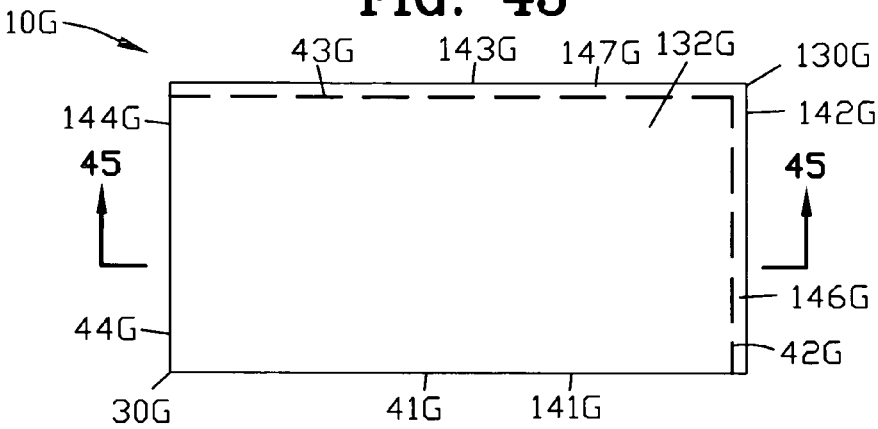
FIG. 44 is top view of the improved acoustic panel of FIG. 43.

FIGS. 43 and 44 are enlarged top and bottom views of the improved acoustic panel 10G of FIGS. 39 and 40. The improved acoustic panel 10G includes a sound blocking member 1300 for blocking the transmission of sound through the sound reducing panel 10G. The sound blocking member 130G comprises a first and a second face surface 131G and 132G and a plurality of peripheral edges 141G-144G.

Figure 45:
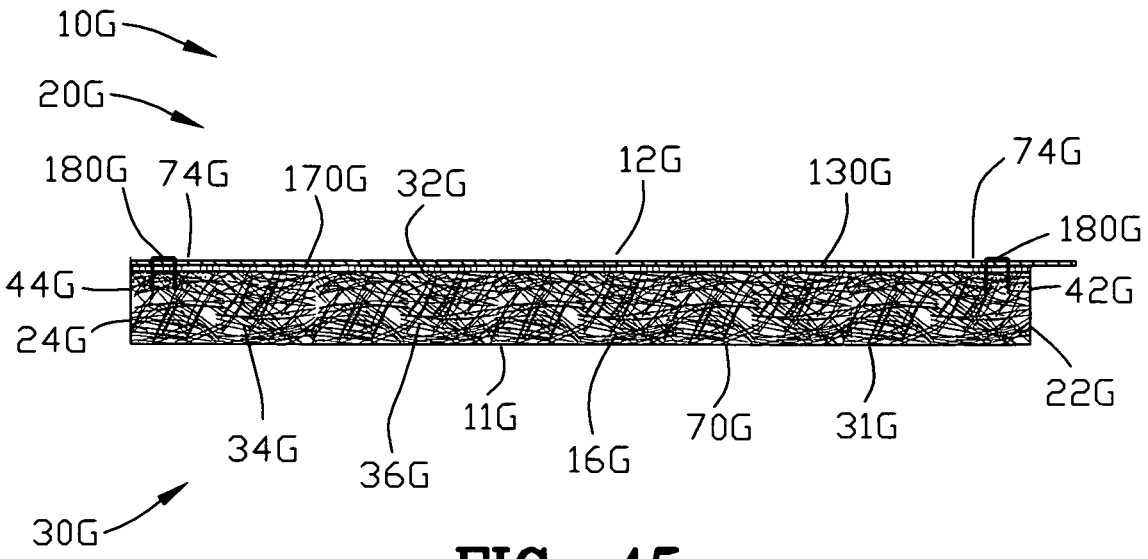
FIG. 45 is a sectional view along line 45-45 in FIG. 44.

FIG. 45 is a sectional view along line 45-45 in FIG. 44. The first face surface 131G of the sound blocking member 130G is displaced from the second face surface 32G of the sound absorbing member 30G defining a space 160G. The space 160G decouples the sound blocking member 130G from the sound absorbing member 30G. The space 160G reduces the transfer of any sound, noise or other vibration from the sound absorbing member 30G to the sound blocking member 130G.

The first face surface 131G of the sound blocking member 130G is displaced from the second face surface 32G of the sound absorbing member 300 by a layer of a spacing material 170G. The spacing material 170G comprises a first and a second face surface 171G and 172G with the first face surface 171G being positioned adjacent to the second face surface 32G of the sound absorbing member 30G.

The first face surface 131G of the sound blocking member 130G positioned adjacent to the second face surface 172G of the spacing material 170G. Preferably, the spacing material 170G comprises a semi-rigid sheet material having a thickness of 0.5 to 1.0 inches and having of density less than the density of the sound absorbing member 30G. One material suitable for use as the spacing material 170G is 0.875 inches production glass (blue fiberglass filter material) manufactured by Flanders Precisionaire. It should be noted that the ⅞ inch production glass compresses under the weight of the sound blocking member 130G to a thickness between 0.25 inches and 0.50 inches.

Figure 46:
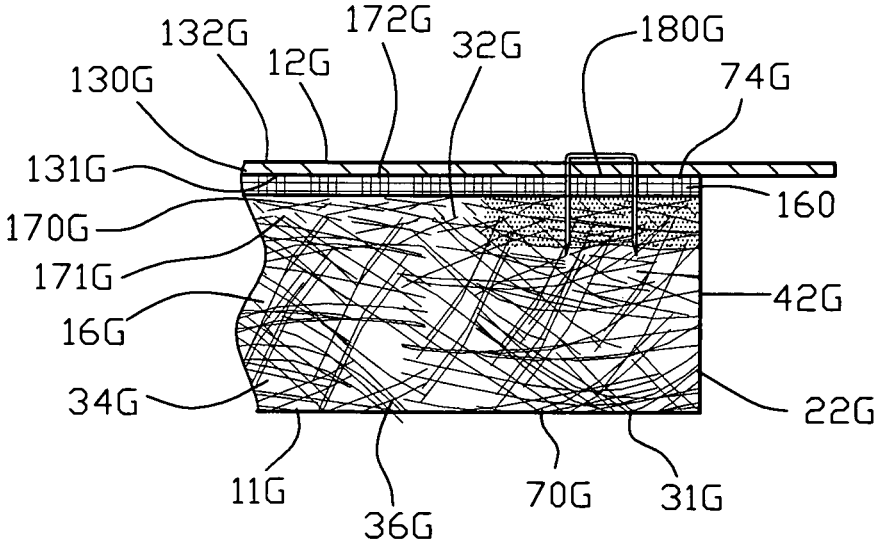
FIG. 46 is a magnified view of a portion of FIG. 45.

FIG. 46 is a magnified view of a portion of FIG. 45. A mechanical fastener shown as a staple 180G, extends through the sound blocking member 130G and the spacing material 170G to fasten with the sound absorbing member 30G. In this example, 1.5 inch staples were used to affix the sound blocking member 130G and spacing material 170G to the sound absorbing member 30G. Preferably, a curable polymeric material is poured upon the peripheral edges 41G-44G of the sound absorbing member 30G to provide a secure base for receiving the staples 180G.

Referring back to FIGS. 40-44, the peripheral edge 142G of the sound blocking member 130G of the acoustic panels

103G overhangs the peripheral edge 144G of the acoustic panels 10G'. The peripheral edge 143G of the sound blocking member 130G of the acoustic panels 10G overhangs the peripheral edge 141G of the acoustic panels 10G". The remaining array of acoustic panels 10G overlay adjacent panels in a similar fashion.

The overhang members 146G and 147G of the peripheral edges 142G and 143G of the sound blocking member 130G acoustic panels 10G overlap the peripheral edges 144G and 141G of adjacent acoustic panels 10G' and 10" when the improved acoustic panel 10G are positioned within the conventional suspended ceiling frame 150G. The overhang members 146 and 147 of sound blocking members 130G overlapping adjacent sound blocking members 130G provides a continuous array sound blocking members 130G over the entirety of the conventional suspended ceiling frame 150G. The continuous array sound blocking members 130G over the entry of the conventional suspended ceiling frame 150G inhibits the transfer of sound above the conventional suspended ceiling frame 150G into adjacent areas.

The acoustic panel of the present invention provides a significant advantage over the prior art. Typically, the sound panels of the prior art operated as either sound absorbing panels or operated as sound blocking panels. Each of the sound absorbing panels and sound blocking panels had distinct advantages as well as distinct disadvantages.

The sound absorbing panels of the prior art provide substantial sound absorbing properties to reduce the amount of reflected sound within a region. However, the sound absorbing panels of the prior art did not prevent sound from migrating into an adjacent region. For example, a sound absorbing ceiling panel of the prior art reduced the amount of reflected sound within a room but did not prevent sound from migrating into an adjacent room.

The sound blocking panels of the prior art prevented the sound from migrating from one region into an adjacent region. However, the sound blocking panels of the prior art did not substantially reduce the amount of reflected sound within the region. For example, a sound blocking ceiling panel of the prior art prevented sound from migrating between adjacent rooms but did not reduced the amount of reflected sound within a room.

The acoustic panel of the present invention provides both of the acoustic functions of the sound absorbing panel as well as the sound blocking panel of the prior art. The sound absorbing member of the improved acoustic panel reduces the amount of reflected sound within a region whereas the sound blocking member of the improved acoustic panel prevents sound from migrating between adjacent regions.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A fire resistant acoustic panel, comprising:

a sound absorbing member defined by a first and second face surface and a peripheral edge;

a sound blocking member secured to said second face surface of said sound absorbing member by an adhesive layer for blocking the transmission of sound through the sound reducing panel;

said sound blocking member being spaced from said second face surface of said sound absorbing member by a spacing sound absorbing member;

said sound blocking member comprising a sheet of mineral filled polymeric material having a thickness of approximately one-eighth of an inch and a weight equal to or greater than one pound per square foot;

a porous covering sheet overlaying said first face of said sound absorbing member, said porous covering sheet being formed from a fire retardant acoustically transparent material; and said porous covering sheet overlays said outer peripheral edges of said sound absorbing member.

2. A fire resistant acoustic panel as set forth in claim 1, wherein said sound blocking member has a sound transmission class greater than 25.

3. A fire resistant acoustic panel as set forth in claim 1, including an inner support frame defined within said sound absorbing member for inhibiting deformation of said sound absorbing member; and said inner support frame including a curable polymeric material impregnated into an interior portion of said sound absorbing member.

4. A fire resistant acoustic panel for use with a suspended ceiling support frame, comprising:

a sound absorbing member defined by a first and second face surface and a plurality of peripheral edges;

a sound blocking member defined by a first and second face surface and a plurality of peripheral edges;

said second face surface of said sound blocking member being adhesively secured to said second face surface of said sound absorbing member for blocking the transmission of sound through the sound reducing panel;

said sound blocking member comprising a sheet of mineral filled polymeric material having a thickness of approximately one-eighth of an inch and having a weight equal to or greater than one pound per square foot;

said sound blocking member having a sound transmission class greater than 25;

an inner frame comprising a curable polymeric material impregnated into an interior portion of said sound absorbing member;

a porous covering sheet overlaying said first face of said sound absorbing member with said peripheral edges of said porous covering sheet overlaying said outer peripheral edges of said sound absorbing member;

said porous covering sheet formed from a fire retardant acoustically transparent material; and a mounting for supporting the improved acoustic panel.

* * * * *